US008757627B1

(12) United States Patent
Sedlacek

(10) Patent No.: US 8,757,627 B1
(45) Date of Patent: Jun. 24, 2014

(54) TARGET SYSTEMS

(76) Inventor: Cory W. Sedlacek, Phoenix, AZ (US)

( * ) Notice: Subject to any disclaimer, the term of this patent is extended or adjusted under 35 U.S.C. 154(b) by 87 days.

(21) Appl. No.: 13/311,775

(22) Filed: Dec. 6, 2011

Related U.S. Application Data

(60) Provisional application No. 61/443,111, filed on Feb. 15, 2011, provisional application No. 61/420,363, filed on Dec. 7, 2010.

(51) Int. Cl.
*F41J 1/00* (2006.01)

(52) U.S. Cl.
USPC ..... 273/407; 273/403

(58) Field of Classification Search
USPC ..... 273/403–410
See application file for complete search history.

(56) References Cited

U.S. PATENT DOCUMENTS

| | | | | | |
|---|---|---|---|---|---|
| 2,090,930 | A * | 8/1937 | Chubb | 273/408 |
| 2,726,870 | A * | 12/1955 | Auger | 273/370 |
| 4,203,600 | A | 5/1980 | Brown | |
| 4,373,733 | A | 2/1983 | Smith, Jr. | |
| 4,508,508 | A | 4/1985 | Theodore | |
| 5,222,741 | A | 6/1993 | Redl | |
| 5,498,001 | A | 3/1996 | Franks et al. | |
| 5,593,162 | A | 1/1997 | Minuskin | |
| 5,669,610 | A | 9/1997 | Salyers | |
| 5,676,378 | A | 10/1997 | West | |
| 5,816,579 | A * | 10/1998 | Broussard et al. | 273/408 |
| 6,254,100 | B1 | 7/2001 | Rinehart | |
| 6,550,773 | B2 | 4/2003 | McKenzie et al. | |
| 6,575,469 | B2 | 6/2003 | Love | |
| 6,983,939 | B2 | 1/2006 | Pulkrabek | |
| 7,134,663 | B1 | 11/2006 | Lowe et al. | |
| 7,207,567 | B1 | 4/2007 | Brown | |
| 7,380,796 | B1 | 6/2008 | Hinton | |
| 7,455,298 | B1 | 11/2008 | Nettle | |
| 7,712,743 | B1 | 5/2010 | Miller | |
| 8,333,385 | B2 * | 12/2012 | McGovern et al. | 273/403 |
| 2005/0167925 | A1 * | 8/2005 | Lewis | 273/403 |
| 2006/0255542 | A1 * | 11/2006 | Lowe et al. | 273/403 |
| 2008/0054570 | A1 | 3/2008 | Potterfield et al. | |

* cited by examiner

*Primary Examiner* — Mark Graham
(74) *Attorney, Agent, or Firm* — Stoneman Law Patent Group; Martin L. Stoneman; David A. Spellman

(57) ABSTRACT

3-D target systems for target practice relating to three-dimensional objects having accuracy markers for internal organs and normally non-visible targets.

16 Claims, 13 Drawing Sheets

TARGET SYSTEMS

CROSS-REFERENCE TO RELATED APPLICATION

The present application is related to and claims priority from prior provisional application Ser. No. 61/443,111, filed Feb. 15, 2011, entitled "TARGET SYSTEMS"; and, this application is related to and claims priority from prior provisional application Ser. No. 61/420,363, filed Dec. 7, 2010, entitled "TARGET SYSTEMS", the contents of all of which are incorporated herein by this reference and are not admitted to be prior art with respect to the present invention by the mention in this cross-reference section.

BACKGROUND

This invention relates to providing a system for improved target systems. More particularly, this invention relates to providing systems and apparatus to assist three-dimensional weapons target training. In target practice, particularly for law enforcement and military personnel, two dimensional targets fail to give adequate training for targeting vital organs, which in real-life situations lie in a three-dimensional space and are hidden within a target (not visible externally). During training to assist a shooter with real-life angled targeting, alterations of a target's angle would be preferably taken into account, since such angle alters the position of the shot to vital organs or other targeted organs inside such target. In order to accurately train during target practice, a way of determining the strike of a weapon (such as, for example, a firearm bullet) at a specific location within at least a three-dimensional target is needed. Further, bullets are destructive and have a tendency to destroy targets and/or target portions. Therefore, a need exists for a target system that better withstands such destruction (lasts longer). Further, a need exists for a target that comprises easily replaceable target and/or target portions. Even further, bullets can ricochet, so a need exists for a target that reduces or eliminates bullet ricochet(s) upon hitting such target(s).

OBJECTS AND FEATURES OF THE INVENTION

A primary object and feature of the present invention is to provide a system overcoming the above-mentioned problem (s).

Another object and feature of the present invention is to provide a system to assist three-dimensional target training with firearms. Another primary object and feature of the present invention is to provide a three-dimensional target representing the torso and head portions of the human body to be used at least for firearms target training practice.

Yet another object and feature of the present invention is to provide a three-dimensional target representing the torso and head portions of the human body which can be readily disposed of and replaced during weapons target training practice.

Yet another object and feature of the present invention is to provide a three-dimensional representation of vital organs which lie on the mid-sagittal and mid-coronal planes of the human torso to be used as a target during firearms target training practice. Yet another object and feature of the present invention is to provide a three-dimensional representation of vital organs which lie on the mid-sagittal and mid-coronal planes of the human head to be used as a target during firearms target training practice.

Yet another object and feature of the present invention is to provide a three-dimensional representation of vital organs which lie on the mid-sagittal and mid-coronal planes which can be readily disposed of and replaced during firearms target training practice.

Another object and feature of the present invention is to provide a three-dimensional representation of vital organs which lie on the mid-sagittal and mid-coronal planes which can be inserted into a cavity of a three-dimensional target representing the torso and head portions of the human body.

Yet another object and feature of the present invention is to provide a target system to reduce or eliminate bullet ricochet upon hitting such target.

Yet another object and feature of the present invention is to provide a target system to assist accurate registering of organs hit during firearms target training practice, particularly when shots are taken at oblique angles.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a target system, relating to at least one three-dimensional target to assist a shooter of the target to determine associated internal organ damage upon striking the target, comprising: at least one first form three-dimensional representation structured and arranged to form representation of at least one torso portion of at least one three-dimensional humanoid; at least one second form representation structured and arranged to represent at least one set of humanoid internal organs; and at least one first coupler structured and arranged to couple such at least one second form representation within such at least one first form three-dimensional representation; wherein such at least one first coupler comprises at least one removable inserter structured and arranged to insert such at least one second form representation into such at least one first form three-dimensional representation; wherein such at least one second form representation comprises at least one three-dimensional representation structured and arranged to three-dimensionally represent such at least one set of humanoid internal organs; and wherein when such at least one second form representation is inserted into and coupled with such at least one first form three-dimensional representation, the at least one three-dimensional target is provided.

Moreover, it provides such a target system, further comprising: at least one first divisible geometry structured and arranged to geometrically divide such first form three-dimensional representation into at least two divisible sections; wherein such at least one first form three-dimensional representation comprises at least one second coupler structured and arranged to couple such at least two divisible sections together; and wherein such at least one first divisible geometry, when geometrically divided, assists such at least one second form representation insertion into such at least one first form three-dimensional representation.

Additionally, it provides such a target system, wherein such at least one second form representation comprises: at least one second divisible geometry structured and arranged to geometrically divide such at least one second form representation into at least two divisible sections; wherein such at least one second form representation comprises at least one third coupler structured and arranged to couple such at least two divisible sections together; wherein when such at least one second form representation is geometrically divided, such at least one second form representation is two-dimensional; and wherein when such at least one second form representation is geometrically coupled by such at least one third coupler, such at least one second form representation is three-dimensional.

Also, it provides such a target system, wherein such at least one second coupler comprises at least one hinge structured and arranged to assist removably coupling such at least two divisible sections together. In addition, it provides such a target system, wherein: such at least one torso portion of such at least one three-dimensional humanoid comprises at least one head portion; and such at least one second coupler is situate about the top of such at least one head of such at least one torso portion of such at least one three-dimensional humanoid. And, it provides such a target system, wherein such at least one hinge comprises at least one non-metallic-hinge structured and arranged to minimize bullet ricochet. Further, it provides such a system wherein said plurality of tab-slot couplers comprises a non-metallic-coupling structured and arranged to minimize bullet ricochet. And, it provides such a system wherein said at least one second coupler comprises at least one non-metallic material structured and arranged to minimize bullet ricochet.

Further, it provides such a target system, wherein such at least one second coupler comprises at least one non-metallic material structured and arranged to minimize bullet ricochet. Even further, it provides such a target system wherein such at least one second form representation comprises at least two two-dimensional portions that, when assembled provide at least one three dimensional representation of at least one humanoid internal organ.

Moreover, it provides such a target system wherein such at least one second form representation is geometrically couplable by slotted cross-sectionally-assembled portions comprising such at least one set of humanoid internal organ representation. Additionally, it provides such a target system wherein: such at least one first form three-dimensional representation comprises at least one coronal plane and at least one sagittal plane; such at least one first form three-dimensional representation comprises at least two divisible sections; and such at least one second form representation inserts into such at least one first form three-dimensional representation along the intersection of such sagittal plane and such coronal plane cross-sections. Also, it provides such a target system, wherein such at least one second form representation comprises at least one brain representation structured and arranged to couple inside such at least one head portion. In addition, it provides such a target system wherein such at least one first form three-dimensional representation comprises essentially molded-pulp in its entirety.

And, it provides such a target system wherein such at least one first form three-dimensional representation comprises essentially thick-wall molded pulp in its entirety. Further, it provides such a target system wherein such at least one first form three-dimensional representation comprises at least two divisible sections along such at least one coronal plane. Even further, it provides such a target system wherein such at least one second form representation comprises shot demarcation indicia structured and arranged to assist determination of organ target-penetration when penetrated. Moreover, it provides such a target system wherein such shot demarcation indicia is structured and arranged to indicate, and assist determination of, angular shot geometry when penetrated. Additionally, it provides such a target system, wherein such at least one first form three-dimensional representation comprises a plurality of fourth couplers structured and arranged to couple at least one arm portion and at least one leg portion to such at least one torso portion. Also, it provides such a target system, wherein such at least one first form three-dimensional representation comprises at least one fifth coupler structured and arranged to couple such at least one head portion.

In accordance with another preferred embodiment hereof, this invention provides a target system related to at least one three-dimensional target to assist a shooter of the target to determine associated internal organ damage upon striking the target, comprising: at least one first form three-dimensional representation, having at least two divisible sections structured and arranged to form representation of at least one three-dimensional vertebrate animal; at least one second form representation structured and arranged to represent at least one set of vertebrate animal internal organs; and at least one removable inserter structured and arranged to insert such at least one second form representation into such at least one first form three-dimensional representation; wherein such at least one first form three-dimensional representation comprises at least one hinge structured and arranged to hinge such at least two divisible sections together; and wherein when such at least one second form representation is inserted into such at least one first form three-dimensional representation the at least one three-dimensional target is provided.

In accordance with another preferred embodiment hereof, this invention provides a target system, relating to at least one three-dimensional target to assist a shooter of the target to determine associated internal organ damage upon striking the target, comprising: first form three-dimensional representation means for form representation of at least one torso portion of at least one three-dimensional humanoid; second form representation means for representing at least one set of humanoid internal organs; and first coupler means for coupling such second form representation means within such first form three-dimensional representation means; wherein such first coupler means comprises removable inserter means for inserting such second form representation means into such first form three-dimensional representation means; wherein such second form representation means comprises three-dimensional representation means for three-dimensional representing of at least one set of humanoid internal organs; and wherein when such second form representation means is inserted into and coupled with such first form three-dimensional representation means the at least one three-dimensional target is provided.

In addition, it provides such a target system further comprising: first divisible geometry means for geometrically dividing such first form three-dimensional representation means into at least two divisible sections; wherein such first form three-dimensional representation means comprises second coupler means for coupling such at least two divisible sections together; and wherein such first divisible geometry means, when geometrically divided, assists such second form representation means insertion into such first form three-dimensional representation means. And, it provides such a target system wherein such second form representation means comprises: second divisible geometry means for geometrically dividing such second form representation means into at least two divisible sections; wherein such second form representation means comprises second coupler means for coupling such at least two divisible sections together; wherein when such second form representation means is geometrically divided, such second form representation means is two-dimensional; and wherein when such second form representation means is geometrically coupled by such second coupler means, such second form representation means is three-dimensional.

In accordance with another preferred embodiment hereof, this invention provides a target system, relating to at least one three-dimensional target to assist a shooter of the target to determine associated internal organ damage upon striking the target, comprising: first form three-dimensional representation means, having at least two divisible sections for form representation of at least one three-dimensional vertebrate animal; second form representation means for representing at least one set of vertebrate animal internal organs; and removable inserter means for inserting such second form representation means into such first form three-dimensional representation means; wherein such first form three-dimensional representation means comprises hinge means for hinging such at least two divisible sections together; and wherein when such second form representation means is inserted into such first form three-dimensional representation means the at least one three-dimensional target is provided.

In accordance with another preferred embodiment hereof, this invention provides a target system, relating to at least one three-dimensional target to assist a shooter of the target to determine associated internal organ damage upon striking the target, comprising: at least one first form three-dimensional representation structured and arranged to form representation of at least one torso portion of at least one three-dimensional humanoid; at least one second form representation structured and arranged to represent at least one set of humanoid internal organs; at least one first coupler structured and arranged to couple such at least one second form representation within such at least one first form three-dimensional representation; and at least one first divisible geometry structured and arranged to geometrically divide such first form three-dimensional representation into at least two divisible sections; wherein such at least one torso portion of such at least one three-dimensional humanoid comprises at least one head portion; wherein such at least one first coupler comprises at least one removable inserter structured and arranged to insert such at least one second form representation into such at least one first form three-dimensional representation; wherein such at least one first form three-dimensional representation comprises at least one second coupler structured and arranged to couple such at least two divisible sections together; wherein such at least one second coupler is situate about the top of such at least one head of such at least one torso portion of such at least one three-dimensional humanoid; wherein such at least one second coupler comprises at least one hinge structured and arranged to assist removably coupling such at least two divisible sections together; wherein such at least one hinge comprises at least one non-metallic-hinge structured and arranged to minimize bullet ricochet; wherein such at least one first form three-dimensional representation comprises at least one coronal plane and at least one sagittal plane; wherein such at least one first form three-dimensional representation comprises essentially thick-wall molded pulp in its entirety; wherein such at least one second form representation comprises at least one three-dimensional representation structured and arranged to three-dimensionally represent such at least one set of humanoid internal organs; wherein when such at least one second form representation is inserted into and coupled with such at least one first form three-dimensional representation, the at least one three-dimensional target is provided; wherein such at least one second form representation inserts into such at least one first form three-dimensional representation along the intersection of such sagittal plane and such coronal plane cross-sections; wherein such at least one second form representation comprises at least one second divisible geometry structured and arranged to geometrically divide such at least one second form representation into at least two divisible sections; wherein such at least one second form representation comprises at least one third coupler structured and arranged to couple such at least two divisible sections together; wherein when such at least one second form representation is geometrically divided, such at least one second form representation is two-dimensional; wherein when such at least one second form representation is geometrically coupled by such at least one third coupler, such at least one second form representation is three-dimensional; wherein such at least one second form representation comprises at least two two-dimensional portions that, when assembled provide at least one three dimensional representation of at least one humanoid internal organ; wherein such at least one second form representation comprises at least one brain representation structured and arranged to couple inside such at least one head portion; wherein such at least one second form representation comprises shot demarcation indicia structured and arranged to assist determination of organ target-penetration when penetrated; and wherein such shot demarcation indicia is structured and arranged to indicate, and assist determination of, angular shot geometry when penetrated.

According to another preferred embodiment of the present invention this invention provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
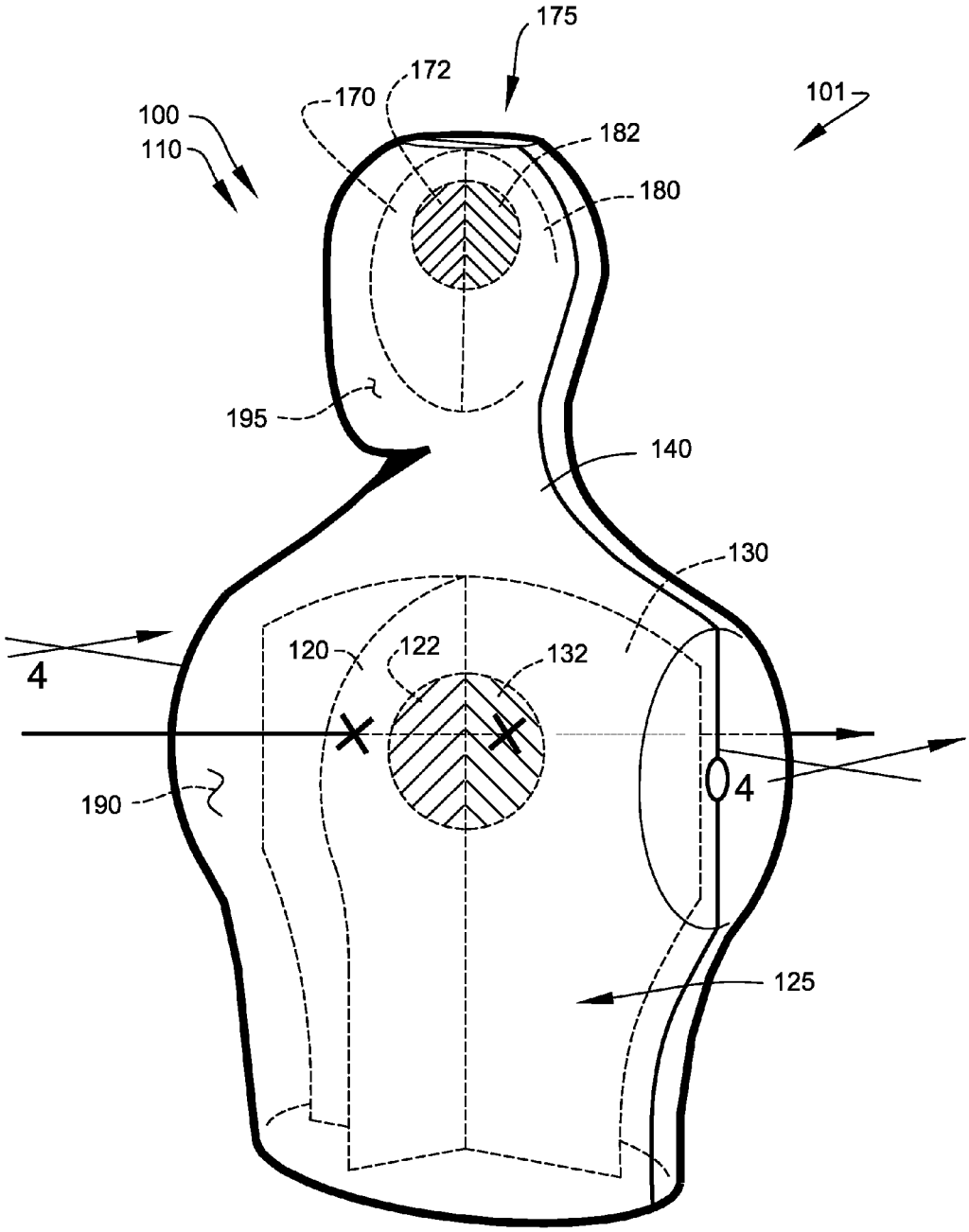
FIG. 1 shows a perspective view, illustrating a three-dimensional target of the target systems, according to a preferred embodiment of the present invention.

FIG. 1 shows a perspective view, illustrating three-dimensional target 101 of target systems 100, according to a preferred embodiment of the present invention. Target systems 100 preferably comprises at least one three-dimensional target 101 preferably comprising at least one outer casing 110 (at least embodying herein at least one first form three-dimensional representation structured and arranged to form representation of at least one torso portion of at least one three-dimensional humanoid; and, at least embodying herein first form three-dimensional representation means for form representation of at least one torso portion of at least one three-dimensional humanoid) which is preferably structured and arranged to provide a three-dimensional representation of the head and torso portions of a human, preferably an adult human male, as shown (this arrangement at least herein embodying wherein such at least one torso portion of such at least one three-dimensional humanoid comprises at least one head portion). Outer casing 110 preferably exist as a one piece design, as shown. Alternately preferably, the head portion may be removably coupled to the torso portion of three-dimensional target 101 (this arrangement at least herein embodying wherein such at least one first form three-dimensional representation comprises at least one fifth coupler structured and arranged to couple such at least one head portion).

Three-dimensional target 101 preferably provides a three-dimensional model structure of a human for preferred use as a target in firearms target training. Three-dimensional target 101 preferably may be useful in firearms target training practice at least for law enforcement or military personnel. Two-dimensional targets used in target training practice often fail to provide an adequate representation of the external contours as well as the arrangement of anatomical structures and organs of the human body, which in real life situations exist in three-dimensional space. Three-dimensional target 101 preferably overcomes this limitation by preferably mimicking the spatial and three-dimensional features of the external and internal structures of a live human target. Three-dimensional target 101 preferably may be targeted from any angle, preferably presenting a view to a shooter which preferably approximates conditions of a live target (see details below).

Three-dimensional target 101 preferably comprises at least one sagittal plane which comprises a plane that divides the body into left and right sections, and at least one mid-sagittal plane which comprises a sagittal plane which passes through the middle of the body. Three-dimensional target 101 further preferably comprises at least one coronal plane which comprises a plane that divides the body into front (ventral) and back (dorsal) sections, and at least one mid-coronal plane which comprises a coronal plane which passes through the middle of the body. This arrangement at least herein embodies wherein such at least one first form three-dimensional representation comprises at least one coronal plane and at least one sagittal plane.

Three-dimensional target 101 preferably comprises at least one sagittal plane insert 120, which preferably lies along the mid-sagittal plane, as shown. Sagittal plane insert 120 preferably comprises sagittal plane indicia 122 which preferably provide at least representational marking of the location of human vital organs existing at least along the sagittal plane, preferably the mid-sagittal plane, as shown. Three-dimensional target 101 further preferably comprises at least one coronal plane insert 130, which preferably lies along the mid-coronal plane, as shown. Coronal plane insert 130 preferably comprises coronal plane indicia 132 which preferably provide at least representational marking of the location of human vital organs existing along the coronal plane, preferably the mid-coronal plane, as shown. Upon reading this specification, those with ordinary skill in the art will now appreciate that, under appropriate circumstances, considering such issues as design preference, user preferences, marketing preferences, cost, structural requirements, available materials, technological advances, etc., other anatomical structure marking such as, for example, major blood vessels, nervous system, bone structures, etc., may suffice.

Sagittal plane insert 120 and coronal plane insert 130 preferably intersect at a ninety-degree angle in order to preferably form at least one torso insert 125, as shown in FIG. 1. Torso insert 125 (at least embodying herein at least one second form representation structured and arranged to represent at least one set of humanoid internal organs; and at least embodying herein second form representation means for representing at least one set of humanoid internal organs) preferably provides a three-dimensional representation of human internal organs inside of the human torso, preferably organs which lie on the mid-sagittal and mid-coronal planes, as shown (see details below). This arrangement at least herein embodies wherein such at least one second form representation comprises at least one three-dimensional representation structured and arranged to three-dimensionally represent such at least one set of humanoid internal organs; and this arrangement at least herein embodies wherein such second form representation means comprises three-dimensional representation means for three-dimensional representing of at least one set of humanoid internal organs. Upon reading this specification, those with ordinary skill in the art will now appreciate that, under appropriate circumstances, considering such issues as design preference, user preferences, marketing preferences, cost, structural requirements, available materials, technological advances, etc., other angular positioning arrangements such as, for example, rotated angular arrangement, supine angular arrangements, prone angular arrangement, etc., may suffice.

Three-dimensional target 101 preferably comprises at least one head sagittal plane insert 170 and at least one head coronal plane insert 180, as shown in FIG. 1. Head sagittal plane insert 170 and head coronal plane insert 180 preferably intersect at a ninety-degree angle in order to preferably form head insert 175, which preferably provides a three-dimensional representation of organ structures existing inside of the human head (see additional details below).

Torso insert 125 and head insert 175, when inserted in outer casing 110, preferably provides three-dimensional target 101, which preferably offers a three-dimensional representation of the external contours of the surface of the human body as well as the internal vital organs (this arrangement at least herein embodying wherein when such at least one second form representation is inserted into and coupled with such at least one first form three-dimensional representation, the at least one three-dimensional target is provided; and this arrangement at least herein embodying wherein when such second form representation means is inserted into and coupled with such first form three-dimensional representation means the at least one three-dimensional target is provided). Three-dimensional target 101 preferably may be useful for assisting target training practice aimed at targeting vital or other specific organs or anatomical structures of the human body. In addition, three-dimensional target 101 preferably may assist with accurate registering of organ hits when shots are taken from oblique angles (see additional details below). Upon reading this specification, those with ordinary skill in the art will now appreciate that, under appropriate circumstances, considering such issues as design preference, user preferences, marketing preferences, cost, structural requirements, available materials, technological advances, etc., other anatomical structure marking such as, for example, major blood vessels, nervous system, bone structures, etc., may suffice.

Outer casing 110 preferably comprises dimensions which preferably approximate the size and geometry of a typical human adult male, as shown. Outer casing 110 preferably comprises a height of about thirty inches, a width of about sixteen inches, and a depth of about nine to ten inches. Upon reading this specification, those with ordinary skill in the art will now appreciate that, under appropriate circumstances, considering such issues as design preference, user preferences, marketing preferences, cost, structural requirements, available materials, desired target type, etc., other dimensions such as, for example, larger, smaller, wider, taller, etc., may suffice.

Outer casing 110 preferably comprises at least one hollow portion preferably comprising at least one cavity 140, as shown. Cavity 140 preferably comprises at least one torso cavity 190 and at least one head cavity 195, as shown in FIG. 1. Torso cavity 190 is preferably structured and arranged to preferably contain at least one torso insert 125, and head cavity 195 is preferably structured and arranged to preferably contain at least one head insert 175, as shown (this arrangement at least embodying herein at least one first coupler structured and arranged to couple such at least one second form representation within such at least one first form three-dimensional representation; and this arrangement at least embodying herein first coupler means for coupling such second form representation means within such first form three-dimensional representation means). Upon reading this specification, those with ordinary skill in the art will now appreciate that, under appropriate circumstances, considering such issues as design preference, user preferences, marketing preferences, cost, structural requirements, available materials, desired target, etc., other torso physical arrangements such as, for example, more solid construction, partially hollow construction, multiple cavities, etc., may suffice.

Outer casing 110 preferably is opaque and non-transparent, in order to preferably hide the contents of cavity 140. Outer casing 110 preferably comprises a preferably moldable, preferably inexpensive, and preferably bullet-penetrable material, preferably molded pulp, preferably thick-wall molded pulp (this arrangement at least herein embodying wherein such at least one first form three-dimensional representation comprises essentially molded-pulp in its entirety; and this arrangement at least herein embodying wherein such at least one first form three-dimensional representation comprises essentially thick-wall molded pulp in its entirety). One advantage of thick-wall molded pulp is that it is relatively inexpensive compared with other potentially suitable materials such as foam and plastics, and can therefore be disposed and replaced at a relatively low cost. Furthermore, thick-wall molded pulp is recyclable and biodegradable. Thick-wall molded pulp is easily penetrated by a bullet, preferably assisting to prevent bullet ricochet. Upon reading this specification, those with ordinary skill in the art will now appreciate that, under appropriate circumstances, considering such issues as design preference, user preferences, marketing preferences, cost, structural requirements, available materials, future technologies, etc., other materials comprising the material qualities described herein, such as, for example, paper products, silicone, other types of molded pulp compositions, etc., may suffice.

Preferably, after withstanding multiple shots, outer casing 110 preferably may be disposed and/or recycled and preferably replaced as desired by the shooter or other user.

Figure 2:
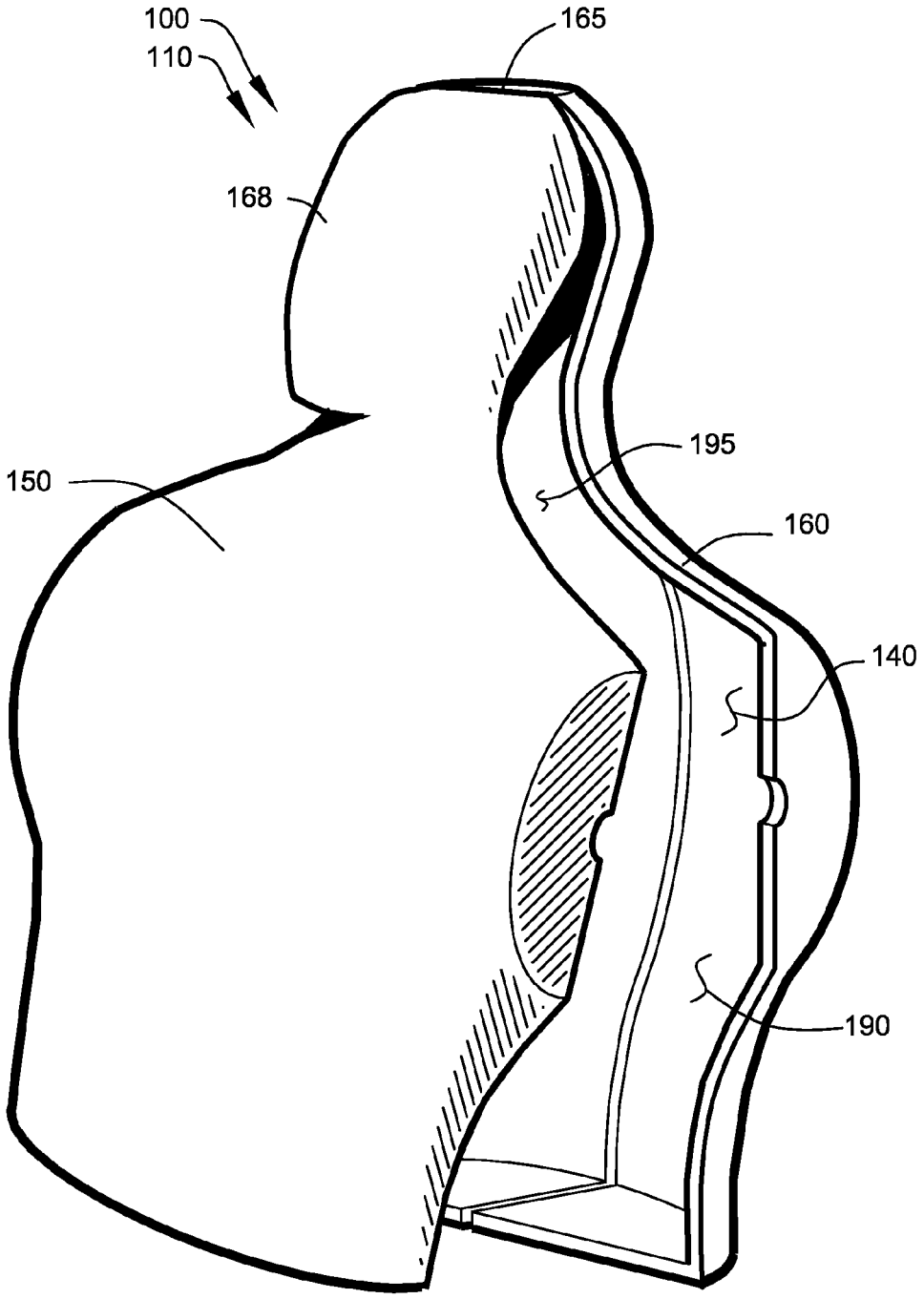
FIG. 2 shows a perspective view, illustrating the dividing of the outer casing of the three-dimensional target along the mid-coronal plane, according to the preferred embodiment of FIG. 1.

FIG. 2 shows a perspective view illustrating the dividing of outer casing 110 of three-dimensional target 101 along the mid-coronal plane, according to the preferred embodiment of FIG. 1. Three-dimensional target 101 preferably is divisible into at least two sections, as shown (this arrangement at least embodying herein at least one first divisible geometry structured and arranged to geometrically divide such first form three-dimensional representation into at least two divisible sections; and at least embodying herein first divisible geometry means for geometrically dividing such first form three-dimensional representation means into at least two divisible sections). Three-dimensional target 101 preferably is divisible into at least one ventral section 150 and at least one dorsal section 160, as shown; preferably, such sections represent the ventral and dorsal sections of at least a vertebrate animal, preferably a human (this arrangement at least herein embodying wherein such at least one first form three-dimensional representation comprises at least two divisible sections; and this arrangement at least embodying at least one first form three-dimensional representation, having at least two divisible sections structured and arranged to form representation of at least one three-dimensional vertebrate animal; and this arrangement at least embodying herein first form three-dimensional representation means, having at least two divisible sections for form representation of at least one three-dimensional vertebrate animal). Three-dimensional target 101 preferably is divisible along the coronal plane, preferably the mid-coronal plane, as shown (this arrangement at least herein embodying wherein such at least one first form three-dimensional representation comprises at least two divisible sections along such at least one coronal plane). Upon reading this specification, those with ordinary skill in the art will now appreciate that, under appropriate circumstances, considering such issues as design preference, user preferences, marketing preferences, cost, structural requirements, available materials, future technologies, etc., other dividing arrangements, such as, for example, divisions along the mid-sagittal plane, divisions along other coronal planes, divisions along the transverse plane, no divisions, etc., may suffice.

Ventral section 150 and dorsal section 160 are preferably connected by at least one hinge 165 (at least herein embodying wherein such at least one first form three-dimensional representation comprises at least one second coupler structured and arranged to couple such at least two divisible sections together; and at least herein embodying wherein such first form three-dimensional representation means comprises second coupler means for coupling such at least two divisible sections together; and at least herein embodying wherein such at least one first form three-dimensional representation comprises at least one hinge structured and arranged to hinge such at least two divisible sections together), as shown. Upon reading this specification, those with ordinary skill in the art will now appreciate that, under appropriate circumstances, considering such issues as design preference, user preferences, marketing preferences, cost, structural requirements, available materials, future technologies, etc., other connecting arrangements, such as, for example, sections which slidably fix together, clip connections, piano hinges, tab/slot arrangements, etc., may suffice.

Hinge 165 preferably is located on top of head portion 168, preferably at least one human head, as shown (this arrangement at least herein embodying wherein such at least one second coupler is situate about the top of such at least one head of such at least one torso portion of such at least one three-dimensional humanoid). Upon reading this specification, those with ordinary skill in the art will now appreciate that, under appropriate circumstances, considering such issues as design preference, user preferences, marketing preferences, cost, structural requirements, available materials, future technologies, etc., other hinge locations, such as, for example, on the side of the body, on the waist, etc., may suffice.

Hinge 165 (at least herein embodying wherein such at least one second coupler comprises at least one hinge structured and arranged to assist removably coupling such at least two divisible sections together; and at least herein embodying wherein such first form three-dimensional representation means comprises hinge means for hinging such at least two divisible sections together) preferably comprises a living-hinge construction (defined herein to mean a thin flexible material that joins two more-rigid parts together, allowing them to bend along the line of the hinge). The living hinge construction of hinge 165 preferably provides a thin section of material to connect ventral section 150 and dorsal section 160 to preferably allow the sections to preferably be opened and closed, as shown in FIG. 2. Hinge 165 preferably comprises a non-metallic material, preferably molded pulp, preferably thick-wall molded pulp. A non-metallic construction of hinge 165 is preferred in order to preferably assist preventing bullet ricochet during target training practice (this arrangement at least herein embodying wherein such at least one second coupler comprises at least one non-metallic material structured and arranged to minimize bullet ricochet). Upon reading this specification, those with ordinary skill in the art will now appreciate that, under appropriate circumstances, considering such issues as design preference, user preferences, marketing preferences, cost, structural requirements, available materials, future technologies, etc., other hinge materials, such as, for example, plastic, fiber, carbon fiber, other paper compounds, etc., may suffice.

The dividing of outer casing 110 into ventral section 150 and dorsal section 160 using hinge 165 preferably exposes cavity 140, as shown in FIG. 2, such that torso insert 125 preferably may be inserted within torso cavity 190 and head insert 175 preferably may be inserted in head cavity 195. This arrangement at least embodies herein at least one removable inserter structured and arranged to insert such at least one second form representation into such at least one first form three-dimensional representation; and this arrangement at least herein embodies wherein such at least one first coupler comprises at least one removable inserter structured and arranged to insert such at least one second form representation into such at least one first form three-dimensional representation; and this arrangement at least herein embodies wherein such first coupler means comprises removable inserter means for inserting such second form representation means into such first form three-dimensional representation means; and this arrangement at least embodies herein removable inserter means for inserting such second form representation means into such first form three-dimensional representation means. Upon reading this specification, those with ordinary skill in the art will now appreciate that, under appropriate circumstances, considering such issues as design preference, user preferences, marketing preferences, cost, structural requirements, available materials, future technologies, desired targets, etc., other arrangement for insertion, such as, for example, insertion through slits, insertion through flaps, etc., may suffice.

Figure 3A:
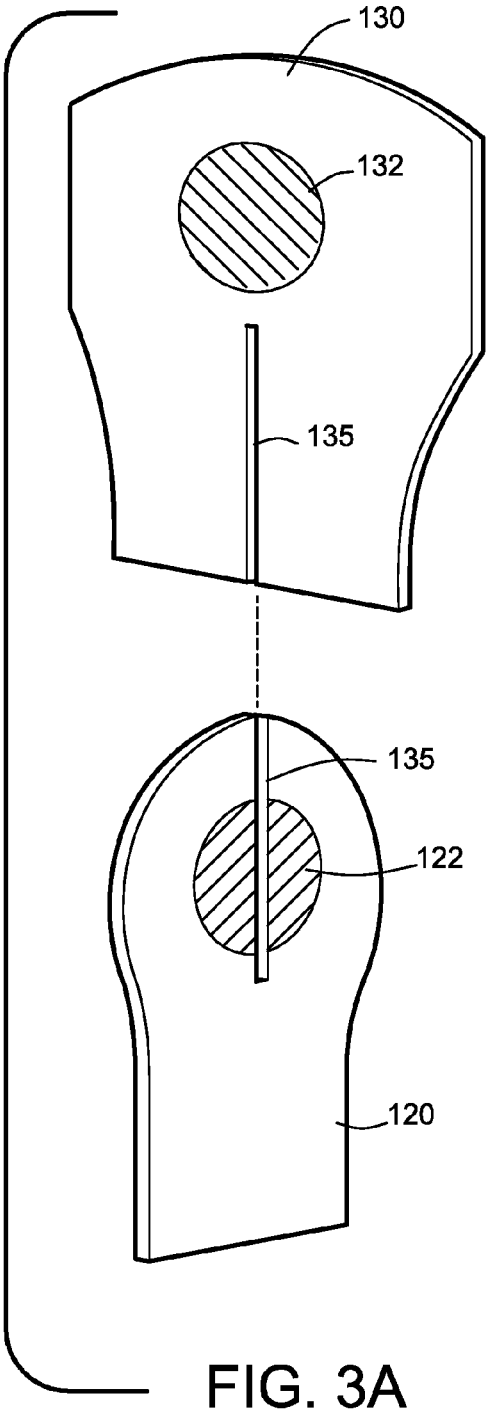
FIG. 3A shows a perspective view, illustrating the intersection of the of the target systems sagittal plane insert and the coronal plane insert at a ninety degree angle, according to the preferred embodiment of FIG. 1.
Figure 3B:
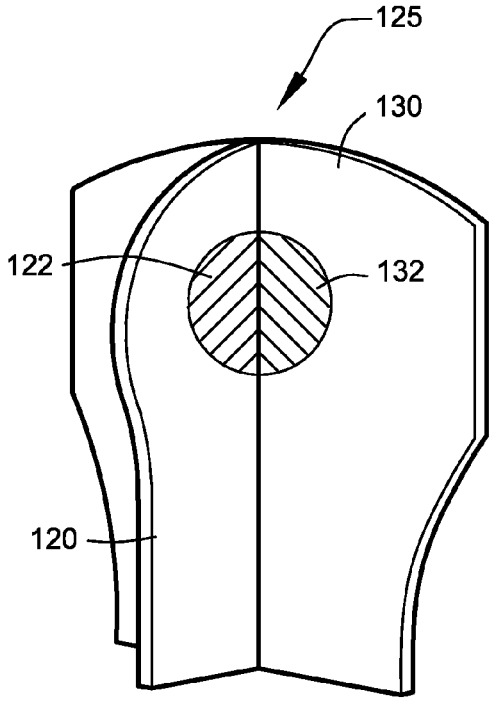
FIG. 3B shows a perspective view, illustrating the torso insert of the three-dimensional target, according to the preferred embodiment of FIG. 1.

Torso insert 125 preferably comprises sagittal plane insert 120 and coronal plane insert 130, as best shown in FIG. 1 and FIG. 3B (this arrangement at least embodying herein at least one second divisible geometry structured and arranged to geometrically divide such at least one second form representation into at least two divisible sections; and this arrangement at least embodying herein second divisible geometry means for geometrically dividing such second form representation means into at least two divisible sections). Sagittal plane insert 120 preferably comprises sagittal plane indicia 122 which preferably provides markings preferably at least illustrating a two-dimensional projection of the location of vital organs and other anatomical structures preferably existing along the sagittal plane, preferably the mid-sagittal plane, as shown (this arrangement at least herein embodying wherein when such at least one second form representation is geometrically divided, such at least one second form representation is two-dimensional; and this arrangement at least herein embodying wherein when such second form representation means is geometrically divided, such second form representation means is two-dimensional). Sagittal plane indicia 122 preferably illustrates the location of skeletal structures, nervous system structures, organs and structures of the cardiovascular system, as well as organs and structures of the respiratory system. Upon reading this specification, those with ordinary skill in the art will now appreciate that, under appropriate circumstances, considering such issues as design preference, user preferences, marketing preferences, cost, structural requirements, available materials, desired targets, etc., other organ markings, such as, for example, liver, spleen, kidney, intestines, etc., may suffice.

Coronal plane insert 130 preferably comprises coronal plane indicia 132 which preferably provides markings preferably at least illustrating a two-dimensional projection of the location of vital organs and other anatomical structures preferably existing along the coronal plane, preferably the mid-coronal plane. Coronal plane indicia 132 preferably illustrates the location of skeletal structures, nervous system structures, organs and structures of the cardiovascular system, as well as organs and structures of the respiratory system. Upon reading this specification, those with ordinary skill in the art will now appreciate that, under appropriate circumstances, considering such issues as design preference, user preferences, marketing preferences, cost, structural requirements, available materials, desired targets, etc., other organ markings, such as, for example, liver, spleen, kidney, intestines, etc., may suffice.

FIG. 3A shows a perspective view illustrating the intersection of the of target systems' 100 sagittal plane insert 120 and coronal plane insert 130 at a ninety degree angle, according to the preferred embodiment of FIG. 1. FIG. 3B shows a perspective view, illustrating torso insert 125 of three-dimensional target 101, according to the preferred embodiment of FIG. 1.

Sagittal plane insert 120 and coronal plane insert 130 each preferably comprise at least one slit 135 (at least herein embodying wherein such at least one second form representation comprises at least one third coupler structured and arranged to couple such at least two divisible sections together; and at least herein embodying wherein such second form representation means comprises second coupler means for coupling such at least two divisible sections together) which preferably allows sagittal plane insert 120 and coronal plane insert 130 to preferably intersect at a ninety-degree angle to form torso insert 125, as shown in FIG. 1 and FIG. 3A. The point of intersection of sagittal plane insert 120 and coronal plane insert 130 preferably occurs at the point of intersection of the mid-sagittal plane and the mid-coronal planes, as best shown in FIG. 1 (this arrangement at least herein embodying wherein such at least one second form representation inserts into such at least one first form three-dimensional representation along the intersection of such sagittal plane and such coronal plane cross-sections). The resulting torso insert 125 preferably at least provides at least one three-dimensional representation of vital organs and other anatomical structures which exist along the mid-sagittal planes and mid-coronal planes of the human torso, as shown in FIG. 3B. This arrangement at least herein embodies wherein such at least one second form representation is geometrically couplable by slotted cross-sectionally-assembled portions comprising such at least one set of humanoid internal organ representation; and this arrangement at least herein embodies wherein such at least one second form representation comprises at least two two-dimensional portions that, when assembled, provide at least one three dimensional representation of at least one humanoid internal organ; and this arrangement at least embodies herein at least one second form representation structured and arranged to represent at least one set of vertebrate animal internal organs; and this arrangement at least embodies herein second form representation means for representing at least one set of vertebrate animal internal organs. Upon reading this specification, those with ordinary skill in the art will now appreciate that, under appropriate circumstances, considering such issues as design preference, user preferences, marketing preferences, cost, structural requirements, available materials, future technologies, etc., other three-dimensional organ representations, such as, for example, the incorporation of a transverse plane insert, a matrix of intersection points, a mathematical algorithmic representation on multiple axes, digital representations, three-dimensional model inserts, etc., may suffice.

Torso insert 125 is preferably structured and arranged to preferably fit within torso cavity 190 of three-dimensional target 101, as best shown in FIG. 1. Preferably, after withstanding several (bullet, arrow, etc) penetrations during target training practice, torso insert 125 preferably may be removed and replaced, as desired by the shooter or other user. The materials of torso insert 125 preferably are chosen such that torso insert 125 preferably may be readily and relatively inexpensively replaced (for example, preferably made of molded pulp as described herein).

Head sagittal plane insert 170 preferably comprises head sagittal plane indicia 172 which preferably provide markings preferably illustrating a two-dimensional projection of the location of vital organs and other anatomical structures existing along the sagittal plane, preferably the mid-sagittal plane, of the human head (see FIG. 1). Head sagittal plane indicia 172 preferably illustrate the location of vital organs existing in the human head, such as brain components, skeletal structures, and nervous system structures. Upon reading this specification, those with ordinary skill in the art will now appreciate that, under appropriate circumstances, considering such issues as design preference, user preferences, marketing preferences, cost, structural requirements, available materials, desired targets, etc., other markings, such as, for example, ocular markings, other sensory organ markings, etc., may suffice.

Head coronal plane insert 180 preferably comprises head coronal plane indicia 182 which preferably provide markings preferably illustrating a two-dimensional projection of the location of vital organs and other anatomical structures existing along the coronal plane, preferably the mid-coronal plane, of the human head (see FIG. 1). Head coronal plane indicia 182 preferably illustrates the location of vital organs existing in the human head, such as brain components, skeletal structures, and nervous system structures. Upon reading this specification, those with ordinary skill in the art will now appreciate that, under appropriate circumstances, considering such issues as design preference, user preferences, marketing preferences, cost, structural requirements, available materials, desired targets, etc., other markings, such as, for example, ocular markings, other sensory organ markings, etc., may suffice.

Head sagittal plane insert 170 and head coronal plane insert 180 preferably intersect at a ninety-degree angle to form head insert 175, which preferably provides at least one three-dimensional representation of vital organs and other anatomical structures existing in the human head, as shown in FIG. 1 (this arrangement at least herein embodying wherein when such at least one second form representation is geometrically coupled by such at least one third coupler, such at least one second form representation is three-dimensional; and this arrangement at least herein embodying wherein when such second form representation means is geometrically coupled by such second coupler means, such second form representation means is three-dimensional). Head insert 175 is preferably structured and arranged to preferably fit within head cavity 195, as best shown in FIG. 1 (this arrangement at least herein embodying wherein such at least one second form representation comprises at least one brain representation structured and arranged to couple inside such at least one head portion). Upon reading this specification, those with ordinary skill in the art will now appreciate that, under appropriate circumstances, considering such issues as design preference, user preferences, marketing preferences, cost, structural requirements, available materials, technological advances, etc., other three-dimensional representation arrangements such as, for example, multiple plane portions, full-organ-sized inserts, etc., may suffice.

After withstanding several shot penetrations during target training practice, head insert 175 preferably may be removed and preferably replaced, as desired by the shooter or other user. The materials of head insert 175 preferably are chosen such that head insert 175 may preferably be readily and inexpensively replaced.

Torso insert 125 and head insert 175 preferably are comprised of an inexpensive, (at least) bullet-penetrable, easily replaceable, and indicia-accepting material, preferably thick-wall molded pulp. Upon reading this specification, those with ordinary skill in the art will now appreciate that, under appropriate circumstances, considering such issues as design preference, user preferences, marketing preferences, cost, structural requirements, available materials, etc., other materials, such as, for example, cardboard, paper, other types of molded pulp, etc., may suffice.

Figure 4:
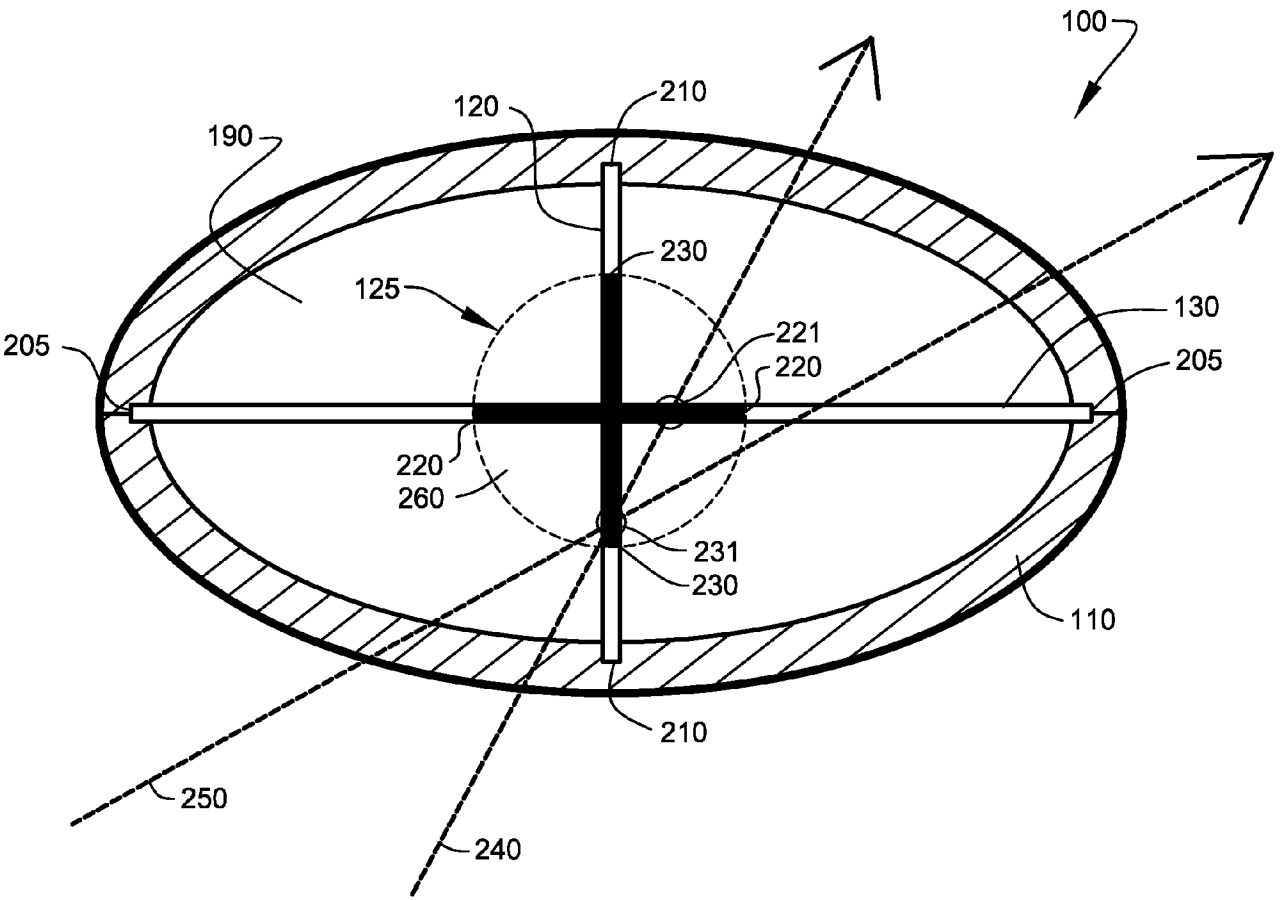
FIG. 4 shows a sectional view, through the section 4-4 of FIG. 1, according to the preferred embodiment of FIG. 1.

FIG. 4 shows a sectional view, through the section 4-4 of FIG. 1, according to the preferred embodiment of FIG. 1. As shown in FIG. 4, outer casing 110 preferably comprises at least two coronal insert apertures 205 and at least two sagittal insert apertures 210. Coronal insert apertures 205 preferably are structured and arranged to preferably receive coronal plane insert 130, and sagittal insert apertures 210 preferably are structured and arranged to preferably receive sagittal plane insert 120, as shown. Coronal insert apertures 205 and sagittal insert apertures 210 preferably are located within torso cavity 190 of outer casing 110, as shown. Coronal insert apertures 205 and sagittal insert apertures 210 preferably assist holding coronal plane insert 130 and sagittal plane insert 120, respectively, in place. Head cavity 195 preferably comprises similar apertures to preferably assist holding head sagittal plane insert 170 and head coronal plane insert 180. Such apertures preferably comprise at least clips, friction clamps, and/or other clamping mechanisms. Upon reading this specification, those with ordinary skill in the art will now appreciate that, under appropriate circumstances, considering such issues as design preference, user preferences, marketing preferences, cost, structural requirements, available materials, future technologies, etc., other holding arrangements, such as, for example, clips, hooks, tacks, etc., may suffice.

FIG. 4 illustrates the utility of torso insert 125 for three-dimensional registering of organ hits during target training practice, particularly when ammunition shots are taken from oblique angles. Coronal plane markings 220 mark the boundaries of target organ 260 lying on the mid-coronal plane, as shown, and sagittal plane markings 230 mark the boundaries of target organ 260 lying on the mid-sagittal plane, as shown. Oblique angle shot 240 is registered at site 231, located on sagittal plane insert 120, and at site 221, located on coronal plane insert 130, as shown, thus notifying the shooter of successful striking of target organ 260 (this arrangement at least herein embodying wherein such at least one second form representation comprises shot demarcation indicia structured and arranged to assist determination of organ target-penetration when penetrated). By contrast, oblique angle shot 250 is registered at site 231, located on sagittal plane insert 120, but is not registered on coronal plane insert 130, given the asymmetrical geometry of target organ 260. In effect, torso insert 125 preferably is able to capture oblique angle shot 250 as a successful strike of target organ 260, which would otherwise be registered as an unsuccessful hit in a strictly two-dimensional hit registering system. As such, three-dimensional target 101 preferably offers the shooter an opportunity to further refine aiming skills for targeting vital organs or other specific organs in living targets, particularly when shots are taken from oblique angles. This arrangement at least herein embodies wherein such shot demarcation indicia is structured and arranged to indicate, and assist determination of, angular shot geometry when penetrated.

In use, a shooter would preferably fire multiple shots at three-dimensional target 101, preferably during firearms target training practice. As outer casing 110 becomes worn from sustaining multiple hits, outer casing 110 preferably may be disposed and replaced, as necessary, for the shooter to preferably continue target training. In addition, as torso insert 125 and/or head insert 175 become worn from sustaining multiple hits, outer casing 110 may be preferably opened at hinge 165 (as best shown in FIG. 2) in order to preferably remove and preferably replace torso insert 125 and/or head insert 175 as desired (this arrangement at least herein embodying wherein such at least one first divisible geometry, when geometrically divided, assists such at least one second form representation insertion into such at least one first form three-dimensional representation; and, this arrangement at least herein embodying wherein such first divisible geometry means, when geometrically divided, assists such second form representation means insertion into such first form three-dimensional representation means). The shooter may preferably reseal outer casing 110 in order to preferably continue firing for target training. The steps of disposing of and replacing outer casing 110, torso insert 125, and/or head insert 175 preferably may be repeated as necessary for continued target training practice.

Figure 5:
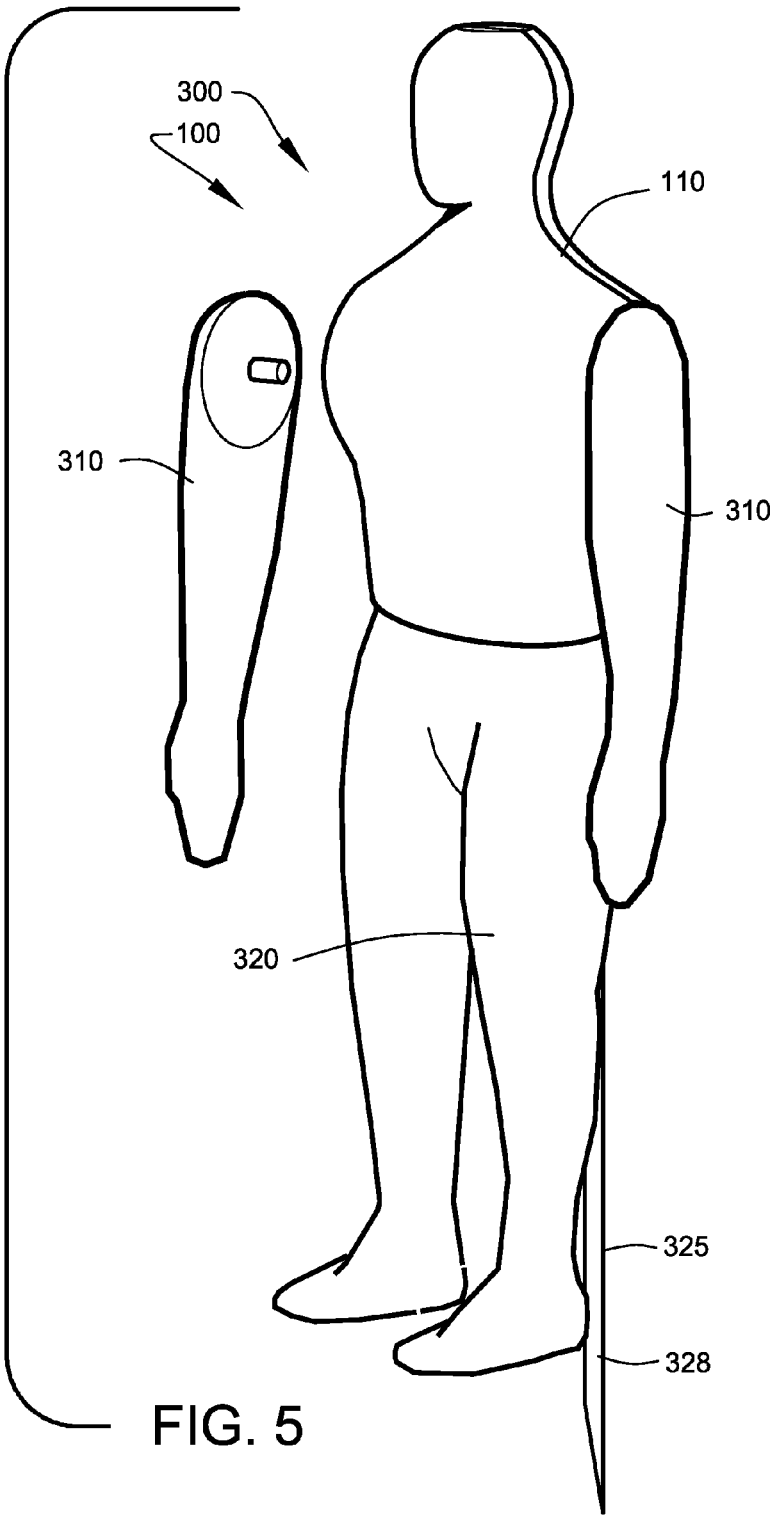
FIG. 5 shows a perspective view, illustrating a three-dimensional target of the target systems, according to another preferred embodiment of the present invention.

FIG. 5 shows a perspective view, illustrating three-dimensional target 300 of target systems 100, according to another preferred embodiment of the present invention. While many features of three-dimensional target 101 are repeated in three-dimensional target 300, three-dimensional target 300 preferably further comprises at least two arm segments 310 and at least one hip/leg segment 320, as shown. Three-dimensional target 300 thus preferably presents a full body three-dimensional target, as shown. Arm segments 310 preferably are manufactured as separate entities and preferably are attached to outer casing 110, as shown, preferably using a suitable joint or coupling mechanism. Similarly, hip/leg segment 320 preferably is manufactured as a single separate unit and preferably is attached to outer casing 110 preferably using a suitable coupling mechanism. This arrangement at least herein embodies wherein such at least one first form three-dimensional representation comprises a plurality of fourth couplers structured and arranged to couple at least one arm portion and at least one leg portion to such at least one torso portion.

Given current molding size constraints during the manufacturing of thick wall molded pulp configurations, arm segments 310 and hip/leg segment 320 preferably are required to be manufactured and attached to outer casing 110 as separate units, as shown in FIG. 5. Upon reading this specification, those with ordinary skill in the art will now appreciate that, under appropriate circumstances, considering such issues as design preference, user preferences, marketing preferences, cost, structural requirements, available materials, future technologies, etc., other holding arrangements, such as, for example, clips, hooks, tacks, etc., may suffice.

Three-dimensional target 101 preferably provides a three-dimensional model structure representing the external features of a human adult and provides a three-dimensional representation of the internal organ structures of a human adult. Upon reading this specification, those with ordinary skill in the art will now appreciate that, under appropriate circumstances, considering such issues as design preference, user preferences, marketing preferences, cost, structural requirements, available materials, desired target, etc., other target structures such as, for example, other animals, rabbits, bear, deer, etc., may suffice.

Furthermore three-dimensional target 101 preferably provides a three-dimensional model structure for preferred use in firearms target training practice. Upon reading this specification, those with ordinary skill in the art will now appreciate that, under appropriate circumstances, considering such issues as design preference, user preferences, marketing preferences, cost, structural requirements, available materials, technological advances, etc., other target training practices such as, for example, archery practice, slingshot practice, hunting practice, etc., may suffice.

Even further, three-dimensional target 101 preferably comprises at least one securer 325, preferably structured and arranged to assist securing such three-dimensional target 101 to at least one secured structure, including the ground (as shown in FIG. 5). Preferably, such at least one securer 325 comprises at least one spike 328. Upon reading this specification, those with ordinary skill in the art will now appreciate that, under appropriate circumstances, considering such issues as design preference, user preferences, marketing preferences, cost, structural requirements, available materials, technological advances, etc., other securer arrangements such as, for example, weighted portions, rope, adhesive, etc., may suffice.

Figure 7:
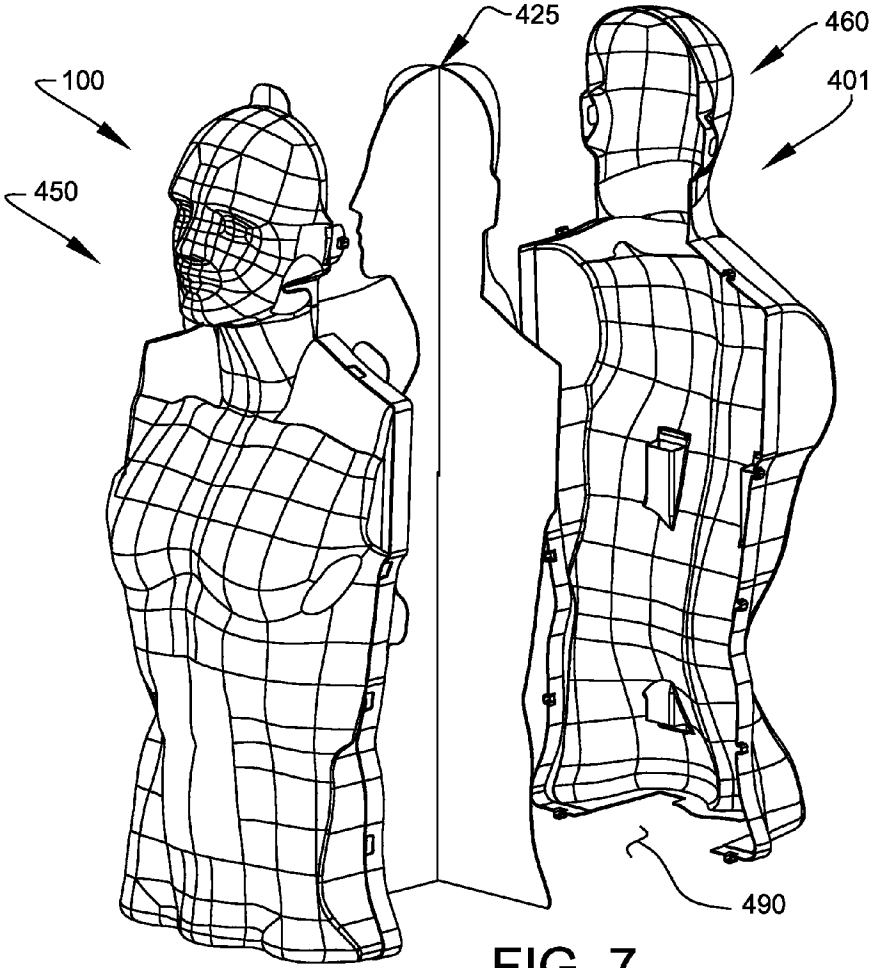
FIG. 7 shows a perspective view, illustrating the dividing of the outer casing of the three-dimensional target along the mid-coronal plane, according to the preferred embodiment of FIG. 6.
Figure 6:
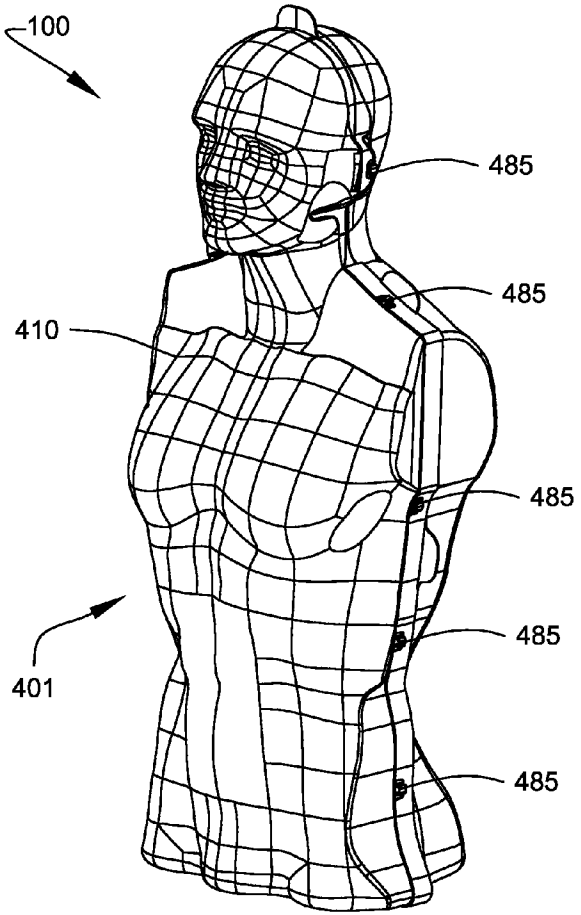
FIG. 6 shows a perspective view, illustrating a three-dimensional target of the target systems, according to another preferred embodiment of the present invention.

FIG. 6 shows a perspective view, illustrating a three-dimensional target 401 of the target systems 100, according to another preferred embodiment of the present invention. Similar in function to three-dimensional target 101, three-dimensional target 401 preferably comprises a more anatomically correct target and a preferably single insert for both the head and torso regions, preferably coupled together utilizing a tab and slot coupler (coupler 485) method (similar to that of an egg carton) rather than a hinge coupler as previously described in the embodiment above. Outer casing 410 preferably comprises a preferably moldable, preferably inexpensive, and preferably bullet-penetrable material, preferably thermoformed molded fiber, preferably MP3-fibre as available from http://www.mp3fibre.com. The preferable product thickness for manufacturing the outer casing 410 is about ⅛ inch (or equal in millimeters). Preferably, outer casing 410 comprises at least one ventral (front) section 450 and at least one dorsal (rear) section 460, as shown in FIG. 7. Preferably, outer casing 410 comprises exactly one ventral (front) section 450 and exactly one dorsal (rear) section 460, as shown in FIG. 7.

Preferably, ventral (front) section 450 and dorsal (rear) section 460 may be combined to form three-dimensional target 401; alternately preferably either may be individually purchased and used as a respective half-portion.

Ventral section 450 and dorsal section 460 are preferably connected by a plurality of couplers 485, preferably removably coupled couplers, preferably tab protrusions having a integral tendency to spring back to an original position (similar to an egg carton tab and slot arrangement) on a first portion of three-dimensional target 401 that couple with opposing slots placed on another portion of three-dimensional target 401, as shown.

FIG. 7 shows a perspective view, illustrating the dividing of the outer casing 410 of the three-dimensional target 401 along the mid-coronal plane, according to the preferred embodiment of FIG. 6.

Three-dimensional target 401 preferably is divisible into at least one ventral section 450 and at least one dorsal section 460, preferably along the mid-coronal plane, as shown; preferably, such sections represent the ventral and dorsal sections of at least a vertebrate animal, preferably a human.

Three-dimensional target 401 preferably comprises at least one head and torso insert 425, preferably one, being preferably structured and arranged to preferably fit within cavity 490 of three-dimensional target 401, as best shown in FIG. 1. Cavity 490 is preferably created when ventral section 450 and dorsal section 460 are coupled together, as shown. Three-dimensional target 101 described above at least teaches using a separate head insert and a torso insert; three-dimensional target 401 preferably comprises at least one combined head and torso insert 425 that preferably may be removed and replaced, as desired by the shooter or other user. Upon reading this specification, those with ordinary skill in the art will now appreciate that, under appropriate circumstances, considering such issues as design preference, user preferences, marketing preferences, cost, structural requirements, available materials, technological advances, etc., other organ insert arrangements such as, for example, partial-organ inserts, more than one insert, etc., may suffice.

The materials of head and torso insert 425 preferably are chosen such that head and torso insert 425 preferably may be readily and relatively inexpensively replaced (for example, preferably made of molded pulp as described herein). Preferably, head and torso insert 425 is comprised essentially of single-wall corrugated cardboard, preferably comprising printed indicia that represent the internal organs of a human target, alternately preferably, the organs that represent whatever animal the target preferably represents. Additional illustrations and details for head and torso insert 425 are further illustrated in FIG. 24 and FIG. 25. Upon reading this specification, those with ordinary skill in the art will now appreciate that, under appropriate circumstances, considering such issues as design preference, user preferences, marketing preferences, cost, structural requirements, available materials, technological advances, etc., other torso insert material arrangements such as, for example, foam, fabric, fibers, plastics, etc., may suffice.

Three-dimensional target 401 preferably offers the shooter an opportunity to further refine aiming skills for targeting vital organs or other specific organs in living targets, particularly when shots are taken from oblique angles.

Figures 8, 9:
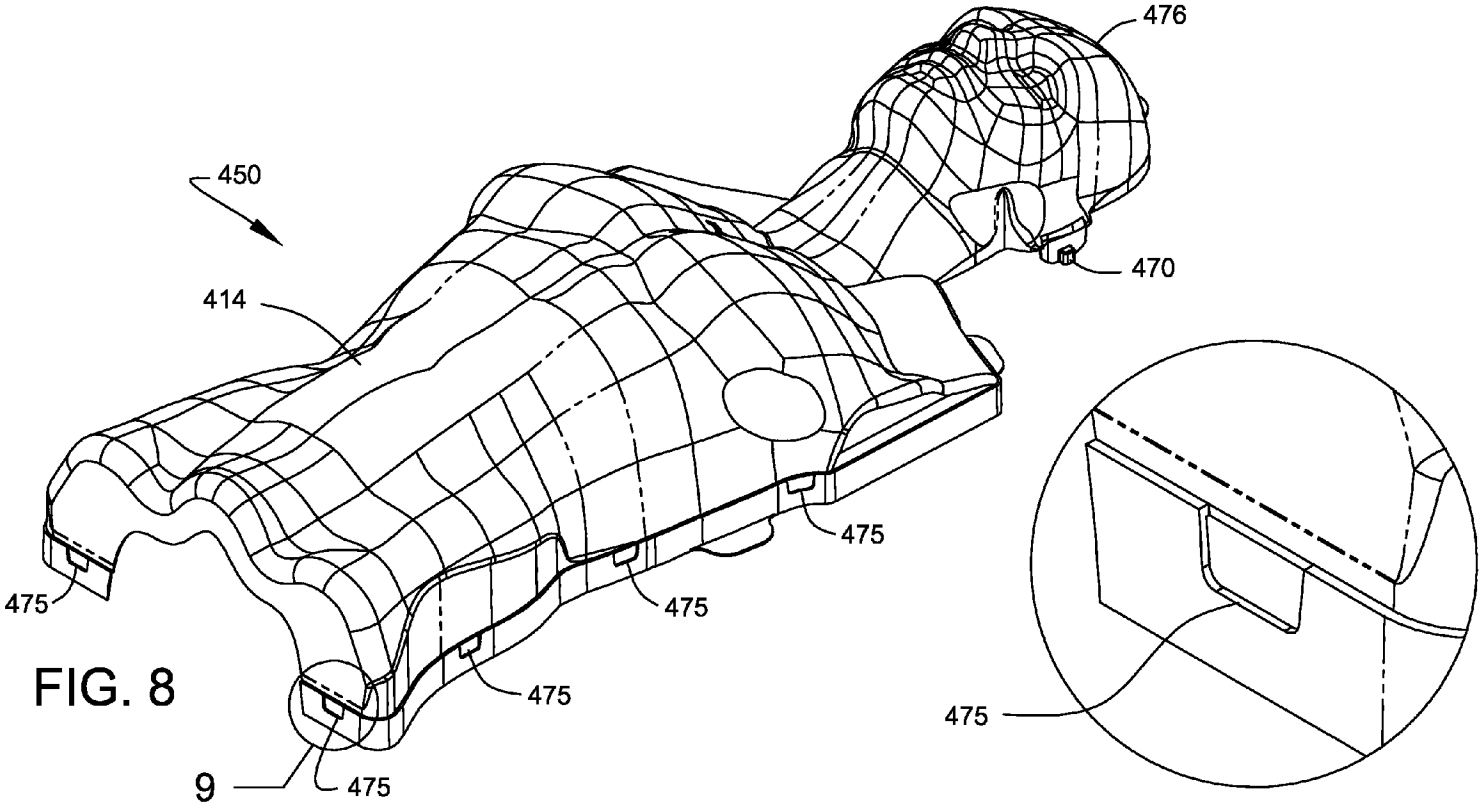
FIG. 8 shows a perspective view, illustrating the exterior of the ventral (front) portion of the outer casing portion of the three-dimensional target, according to the preferred embodiment of FIG. 6.
FIG. 9 shows a detail view of Detail 9 of FIG. 8.
Figures 10, 11, 12:
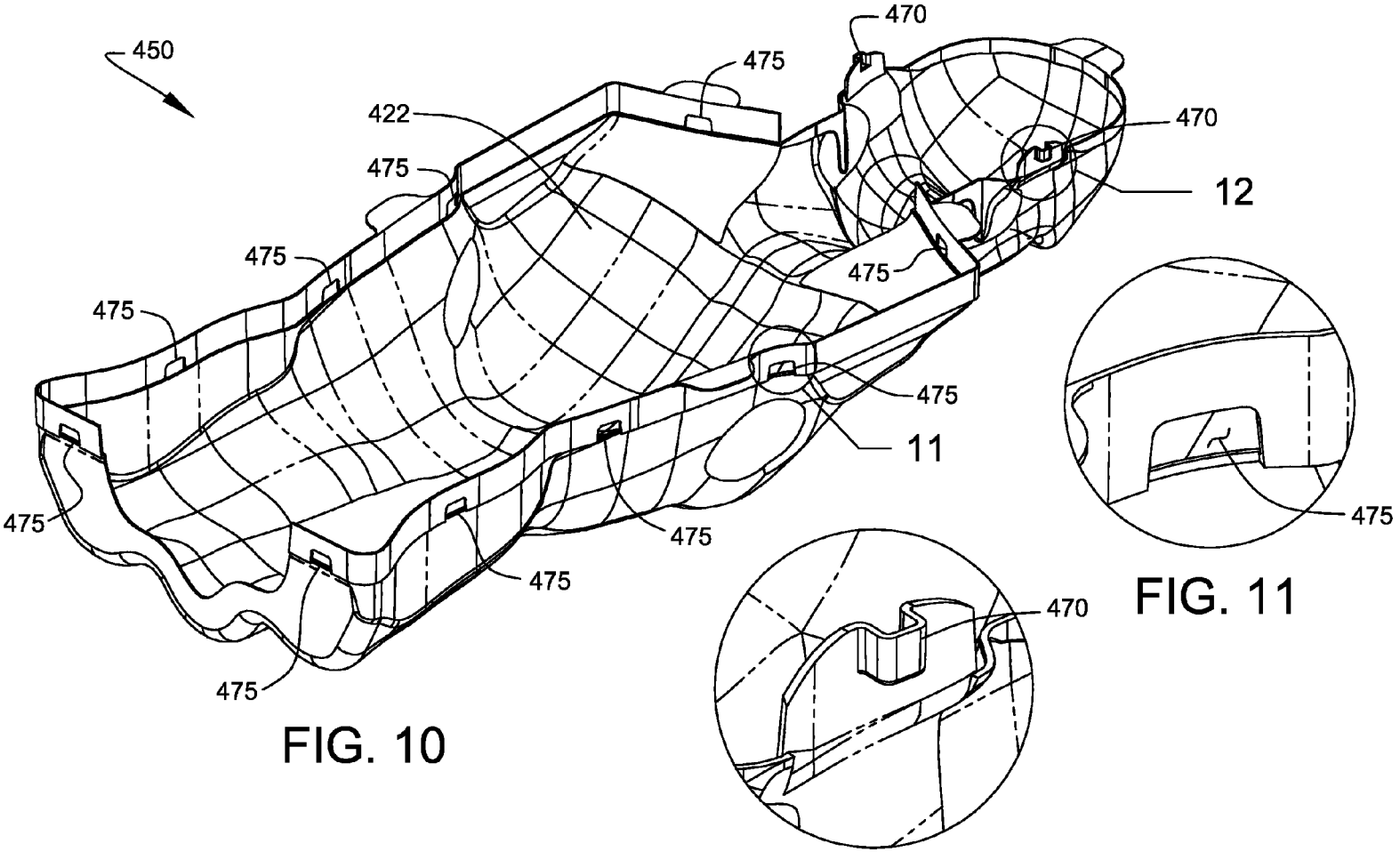
FIG. 10 shows a perspective view, illustrating the interior of the ventral (front) portion of the outer casing portion of the three-dimensional target, according to the preferred embodiment of FIG. 6.
FIG. 11 shows a detail view of Detail 11 of FIG. 10.
FIG. 12 shows a detail view of Detail 12 of FIG. 10.
Figure 13:
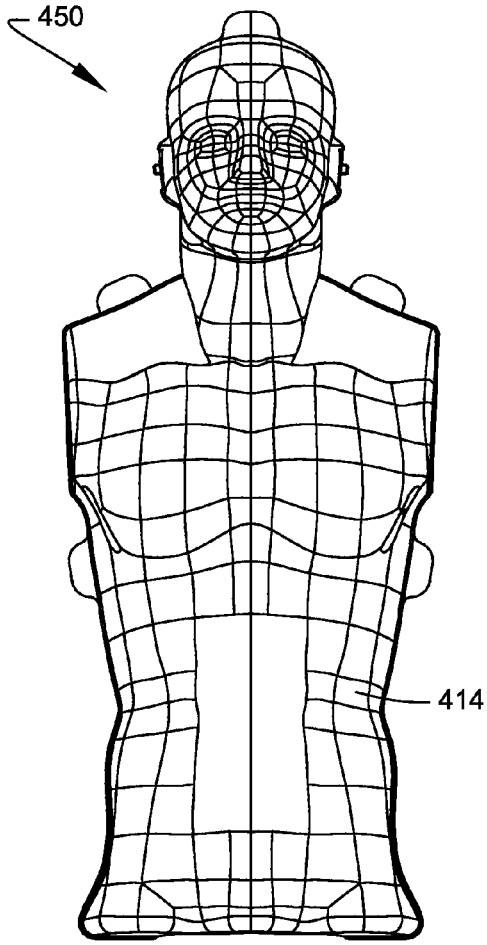
FIG. 13 shows a front view, of the exterior of the ventral (front) portion of the outer casing portion of the three-dimensional target, according to the preferred embodiment of FIG. 6.
Figure 14:
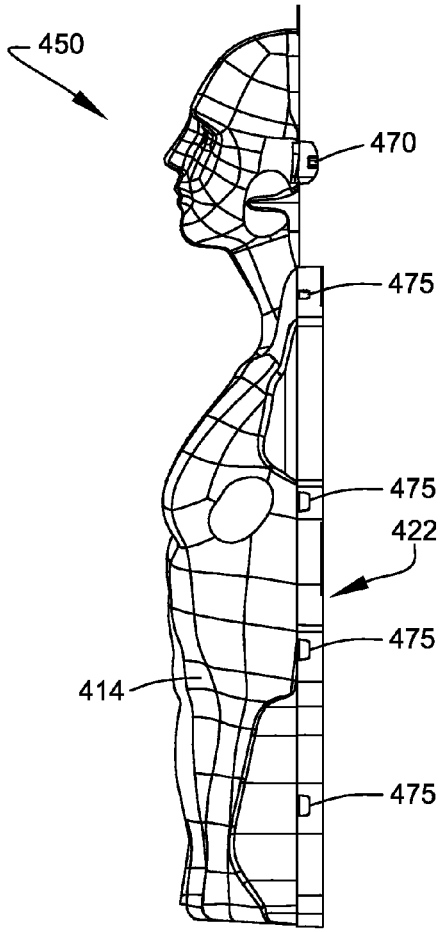
FIG. 14 shows a side view, of the exterior of the ventral (front) portion of the outer casing portion of the three-dimensional target, according to the preferred embodiment of FIG. 6.
Figure 15:
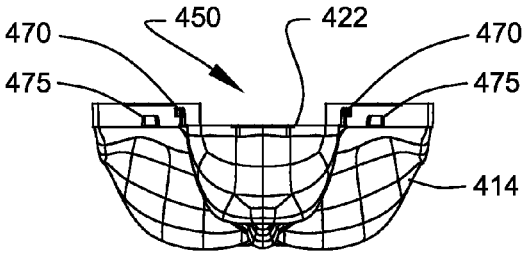
FIG. 15 shows a top view, of the ventral (front) portion of the outer casing portion of the three-dimensional target, according to the preferred embodiment of FIG. 6.

FIG. 8 shows a perspective view, illustrating the exterior 414 of the ventral (front) portion 450 of the outer casing 410 of three-dimensional target 401, according to the preferred embodiment of FIG. 6. FIG. 9 shows a detail view of Detail 9 of FIG. 8. FIG. 10 shows a perspective view, illustrating the interior 422 of the ventral (front) portion 450 of the outer casing 410 of three-dimensional target 401, according to the preferred embodiment of FIG. 6. FIG. 11 shows a detail view of Detail 11 of FIG. 10. FIG. 12 shows a detail view of Detail 12 of FIG. 10. FIG. 13 shows a front view, of the exterior of the ventral (front) portion 450 of the outer casing 410 of the three-dimensional target 401, according to the preferred embodiment of FIG. 6. FIG. 14 shows a side view, of the exterior of the ventral (front) portion 450 of outer casing 410 of three-dimensional target 401, according to the preferred embodiment of FIG. 6. FIG. 15 shows a top view, of the ventral (front) portion 450 of outer casing portion 410 of three-dimensional target 401, according to the preferred embodiment of FIG. 6.

Ventral section 450 and dorsal section 460 are preferably connected by a plurality of couplers 485, preferably removably coupled couplers, preferably tab protrusions having a integral tendency to spring back to an original position (similar to an egg carton tab and slot arrangement) on a first portion of three-dimensional target 401 that couple with opposing slots placed on another portion of three-dimensional target 401, as shown in FIG. 6.

Preferably, situate along the perimeter of outer casing 410, are a plurality of tabs 470 and/or slots 475 structured and arranged to removably couple to each other respective tab 470/slot 475, as shown. In the preferred embodiment illustrated in FIGS. 8-15, head portion 476 comprises at least one tab 470 preferably situate at about the location of a first ear, and at least one tab 470 preferably situated at the opposed second ear portion, as shown.

Tabs 470/slots 475 located on ventral portion 450 preferably align with opposed tabs 470/slots 475 located on dorsal section 460, as shown. Preferably, slots 475 are situate along the perimeter of ventral portion 450 approximately about five inches to about 8 inches apart from each other slot 475, as shown.

Upon reading this specification, those with ordinary skill in the art will now appreciate that, under appropriate circumstances, considering such issues as design preference, user preferences, marketing preferences, cost, structural requirements, available materials, technological advances, etc., other slot separation arrangements such as, for example, closer or farther apart, more or less coupler arrangements, etc., may suffice. Further, upon reading this specification, those with ordinary skill in the art will now appreciate that, under appropriate circumstances, considering such issues as design preference, user preferences, marketing preferences, cost, structural requirements, available materials, technological advances, etc., other tab/slot arrangements such as, for example, alternating tab/slots, opposite tab/slot positioning, etc., may suffice.

Figure 16:
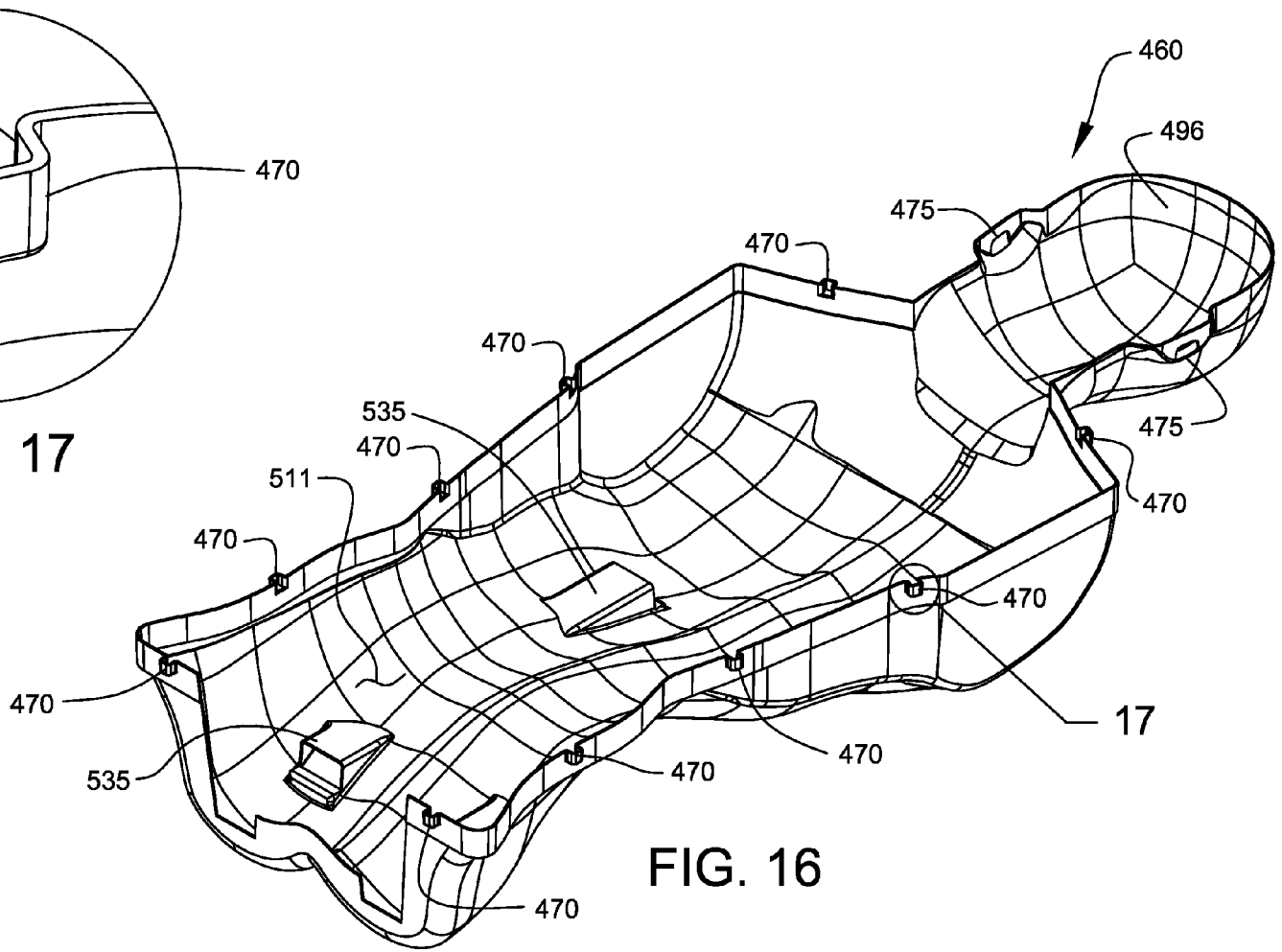
FIG. 16 shows a perspective view, illustrating the interior of the dorsal (back) portion of the outer casing portion of the three-dimensional target, according to the preferred embodiment of FIG. 6.
Figure 17:
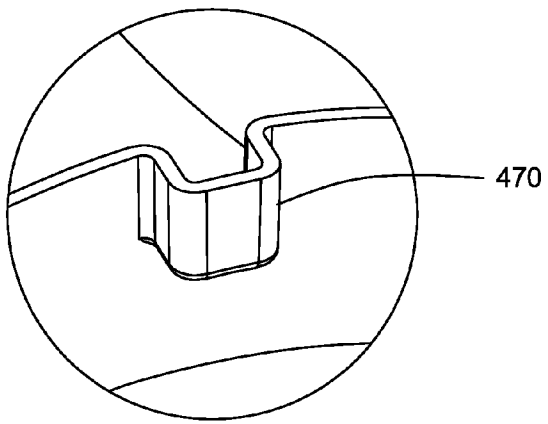
FIG. 17 shows a detail view of Detail 17 of FIG. 16.
Figures 18, 19, 20:
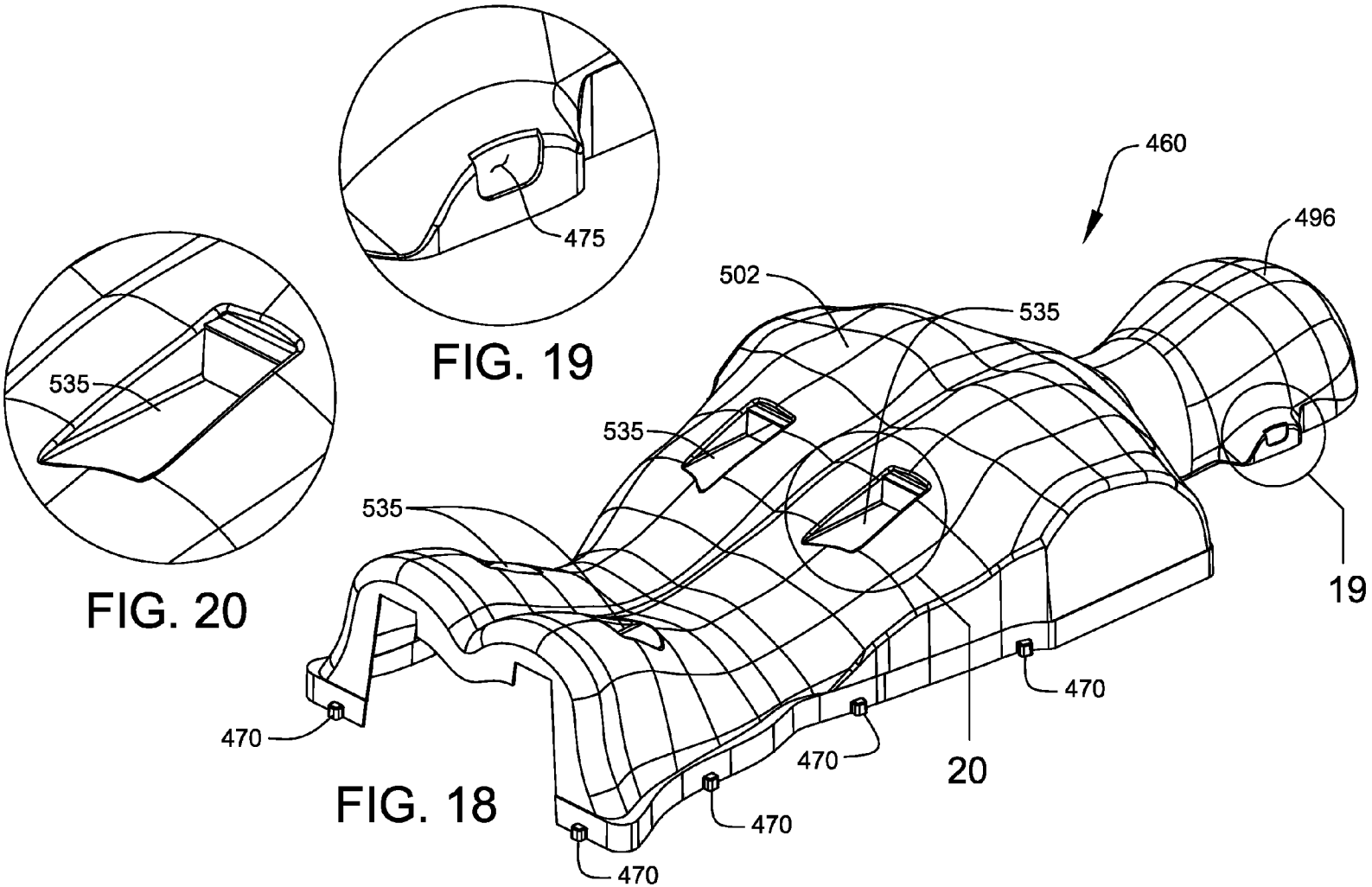
FIG. 18 shows a perspective view, illustrating the exterior of the dorsal (back) portion of the outer casing portion of the three-dimensional target, according to the preferred embodiment of FIG. 6.
FIG. 19 shows a detail view of Detail 19 of FIG. 18.
FIG. 20 shows a detail view of Detail 20 of FIG. 18.

FIG. 16 shows a perspective view, illustrating the interior 511 of the dorsal (back) portion 460 of outer casing 410 of three-dimensional target 401, according to the preferred embodiment of FIG. 6. FIG. 17 shows a detail view of Detail 17 of FIG. 16. FIG. 18 shows a perspective view, illustrating the exterior 502 of the dorsal (back) portion 460 of outer casing 410 of three-dimensional target 401, according to the preferred embodiment of FIG. 6. FIG. 19 shows a detail view of Detail 19 of FIG. 18. FIG. 20 shows a detail view of Detail 20 of FIG. 18.

As stated above, ventral section 450 and dorsal section 460 are preferably connected by a plurality of couplers 485, preferably spring-tab protrusions on a first portion of three-dimensional target 401 that couple with opposing slots placed on another portion of three-dimensional target 401, as shown.

Preferably, situate along the perimeter of outer casing 410, are a plurality of tabs 470 and/or slots 475 structured and arranged to couple to each other respective tab 470/slot 475, as shown. In the preferred embodiment illustrated in FIGS. 16-20, head portion 496 comprises at least one slot 475 preferably situate at about the location of a first ear, and at least one slot 475 preferably situated at the opposed second ear portion, as shown.

Tabs 470/slots 475 located on dorsal portion 450 preferably align with opposed tabs 470/slots 475 located on ventral section 450, as shown. Preferably, tabs 470 are situate along the perimeter of dorsal (back) portion 460 approximately about five inches to about 8 inches apart from each other tab 470, as shown.

Upon reading this specification, those with ordinary skill in the art will now appreciate that, under appropriate circumstances, considering such issues as design preference, user preferences, marketing preferences, cost, structural requirements, available materials, technological advances, etc., other slot separation arrangements such as, for example, closer or farther apart, more or less coupler arrangements, etc., may suffice.

Figure 21:
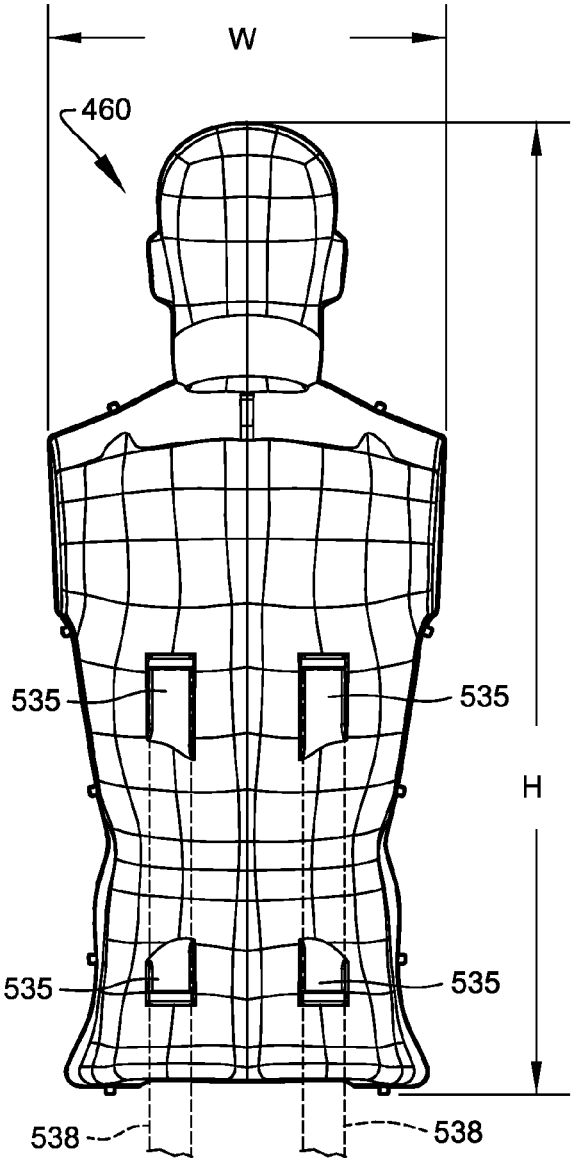
FIG. 21 shows a front view of the exterior of the dorsal (back) portion of the outer casing portion of the three-dimensional target, according to the preferred embodiment of FIG. 6.

FIG. 21 shows a front view of the exterior 502 of the dorsal (back) portion 460 of the outer casing 410 of three-dimensional target 401, according to the preferred embodiment of FIG. 6. Preferred dimensions of three-dimensional target 401 are as follows: a preferred width "W" of about 15½ inches; a preferred height "H" of about 37¾ inches; and, a preferred depth "D" of about 6 inches for each respective half—with a total depth of about 12 inches. Upon reading this specification, those with ordinary skill in the art will now appreciate that, under appropriate circumstances, considering such issues as design preference, user preferences, marketing preferences, cost, structural requirements, available materials, technological advances, etc., other dimension arrangements such as, for example, varying by adult, child, male, female, etc., may suffice. Further, upon reading this specification, those with ordinary skill in the art will now appreciate that, under appropriate circumstances, considering such issues as design preference, user preferences, marketing preferences, cost, structural requirements, available materials, technological advances, etc., other dimension arrangements such as, for example, when using other than a human three-dimensional target, etc., may suffice.

Figure 22:
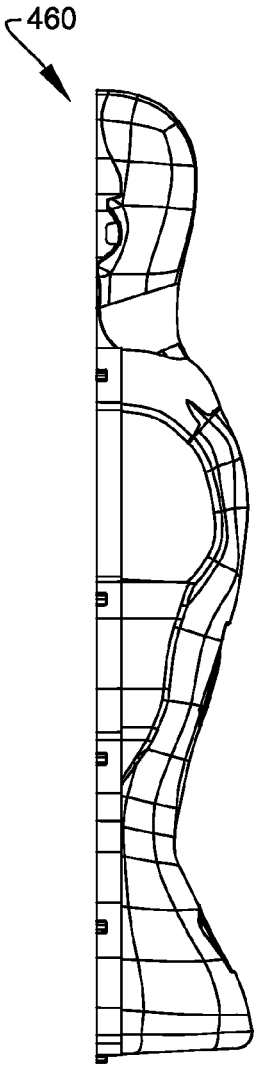
FIG. 22 shows a side view of the exterior of the dorsal (back) portion of the outer casing portion of the three-dimensional target, according to the preferred embodiment of FIG. 6.
Figure 23:
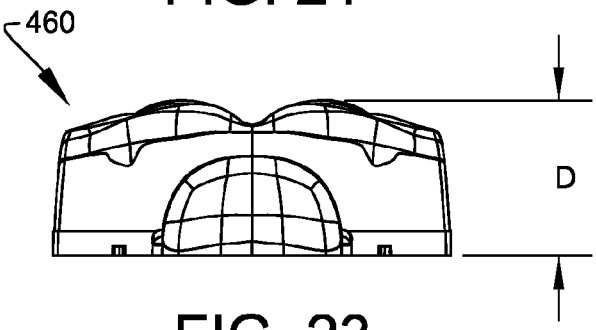
FIG. 23 shows a top view of the dorsal (back) portion of the outer casing portion of the three-dimensional target, according to the preferred embodiment of FIG. 6.

FIG. 22 shows a side view of the exterior 502 of the dorsal (back) portion 460 of outer casing 410 of three-dimensional target 401, according to the preferred embodiment of FIG. 6. FIG. 23 shows a top view of the dorsal (back) portion 460 of the outer casing 410 of three-dimensional target 401, according to the preferred embodiment of FIG. 6.

Three-dimensional target 401 preferably comprises at least one securer 535, preferably structured and arranged to assist securing such three-dimensional target 401 to at least one secured structure, including the ground (as shown in FIG. 21). Preferably, such at least one securer 535 is situate along the exterior 502 of the dorsal (back) portion 460 of outer casing 410 and along the interior 511 of dorsal (back) portion 460 of outer casing 410, as shown. Securer 535 preferably is structured and arranged to couple at least one wooden post 538 (as shown in FIG. 21), preferably there are two securers to secure to two wooden posts 538, preferably each such wooden post 538 comprising about a one inch by two inch (nominal) wood strip, more commonly called a "1×2" furring strip, available and utilized at target shooting ranges. Preferably, such at least one securer 535 does not ricochet a bullet when struck. Upon reading this specification, those with ordinary skill in the art will now appreciate that, under appropriate circumstances, considering such issues as design preference, user preferences, marketing preferences, cost, structural requirements, available materials, technological advances, etc., other securer arrangements such as, for example, weighted portions, rope, adhesive, etc., may suffice.

Figure 24:
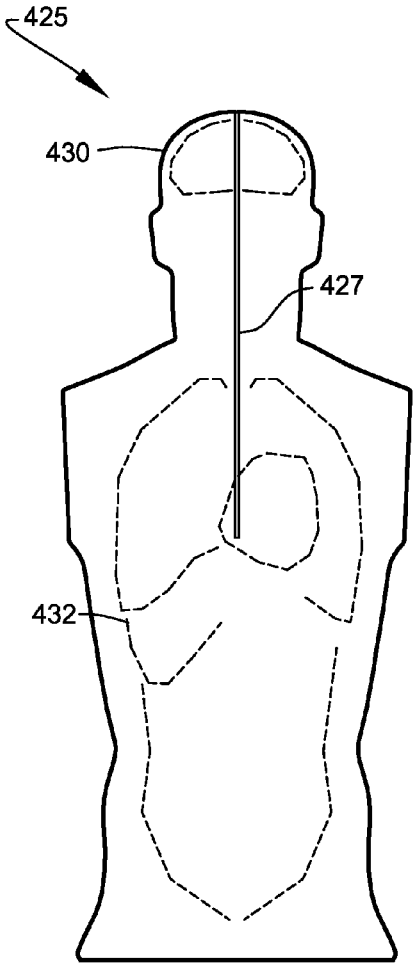
FIG. 24 shows a front view of a first half of a torso insert of the three-dimensional target of the target systems, according to another preferred embodiment of the present invention.
Figure 25:
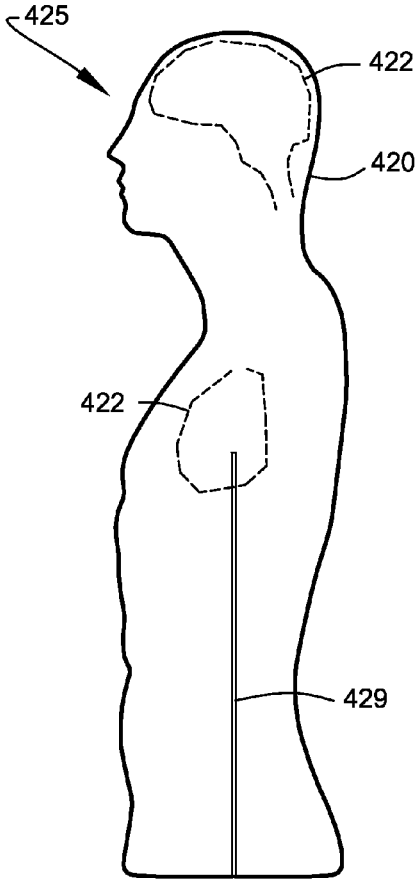
FIG. 25 shows a front view of a second half of a torso insert of the three-dimensional target of the target systems, according to another preferred embodiment of the present invention.

FIG. 24 shows a front view of a first half of head and torso insert 425 of the three-dimensional target 401 of the target systems 100, according to another preferred embodiment of the present invention. FIG. 25 shows a front view of a second half of head and torso insert 425 of the three-dimensional target 401 of the target systems 100, according to another preferred embodiment of the present invention.

Three-dimensional target 401 preferably comprises at least one sagittal plane insert 420, which preferably lies along the mid-sagittal plane, as shown. Sagittal plane insert 420 preferably comprises sagittal plane indicia 422 which preferably provide at least representational marking of the location of human vital organs existing at least along the sagittal plane, preferably the mid-sagittal plane, as shown. Three-dimensional target 401 further preferably comprises at least one coronal plane insert 430, which preferably lies along the mid-coronal plane, as shown. Coronal plane insert 430 preferably comprises coronal plane indicia 432 which preferably provide at least representational marking of the location of human vital organs existing along the coronal plane, preferably the mid-coronal plane, as shown. Upon reading this specification, those with ordinary skill in the art will now appreciate that, under appropriate circumstances, considering such issues as design preference, user preferences, marketing preferences, cost, structural requirements, available materials, technological advances, etc., other anatomical structure marking such as, for example, major blood vessels, nervous system, bone structures, etc., may suffice.

Sagittal plane insert 420 and coronal plane insert 430 preferably comprise slotted portion 427 (FIG. 24) and slotted portion 429 (FIG. 25) respectively that preferably may be coupled together at the slotted portions intersection at about a ninety-degree angle in order to preferably form at least one head and torso insert 425, as shown in FIGS. 24-25, as shown. Head and torso insert 425 preferably provides a three-dimensional representation of human internal organs inside of the human torso, preferably at least organs which lie on the mid-sagittal and mid-coronal planes, as shown (see details below). Upon reading this specification, those with ordinary skill in the art will now appreciate that, under appropriate circumstances, considering such issues as design preference, user preferences, marketing preferences, cost, structural requirements, available materials, technological advances, etc., other angular positioning arrangements such as, for example, rotated angular arrangement, supine angular arrangements, prone angular arrangement, etc., may suffice.

Head and torso insert 425 preferably is held within three-dimensional target 401 by simple clamping and friction hold of the two halves of the three-dimensional target 401. Upon reading this specification, those with ordinary skill in the art will now appreciate that, under appropriate circumstances, considering such issues as design preference, user preferences, marketing preferences, cost, structural requirements, available materials, future technologies, etc., other holding arrangements, such as, for example, clips, hooks, tacks, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A target system, relating to at least one three-dimensional target to assist a shooter of the target to determine associated internal organ damage upon striking the target, comprising:

a) at least one first form three-dimensional representation structured and arranged to form representation of at least one torso portion of at least one three-dimensional humanoid;

b) at least one second form representation structured and arranged to represent at least one set of humanoid internal organs; and c) at least one first coupler structured and arranged to couple said at least one second form representation within said at least one first form three-dimensional representation;

d) wherein said at least one first coupler comprises at least one removable inserter structured and arranged to insert said at least one second form representation into said at least one first form three-dimensional representation;

e) wherein said at least one second form representation comprises at least one three-dimensional representation structured and arranged to three-dimensionally represent such at least one set of humanoid internal organs;

f) wherein when said at least one second form representation is inserted into and coupled with said at least one first form three-dimensional representation, the at least one three-dimensional target is provided;

g) wherein said at least one second form representation comprises:

i) at least one first divisible geometry structured and arranged to geometrically divide said at least one second form representation into at least two divisible sections;

ii) wherein said at least one second form representation comprises at least one third coupler structured and arranged to couple said at least two divisible sections together;

iii) wherein when said at least one second form representation is geometrically divided, said at least one second form representation is two-dimensional; and iv) wherein when said at least one second form representation is geometrically coupled by said at least one third coupler, said at least one second form representation is three-dimensional.

2. The target system, according to claim 1, further comprising:

a) at least one second divisible geometry structured and arranged to geometrically divide said first form three-dimensional representation into at least two divisible sections;

b) wherein said at least one first form three-dimensional representation comprises at least one second coupler structured and arranged to couple said at least two divisible sections together; and c) wherein said at least one second divisible geometry, when geometrically divided, assists said at least one second form representation insertion into said at least one first form three-dimensional representation.

3. The target system, according to claim 2, wherein said at least one second coupler comprises a plurality of tab-slot couplers structured and arranged to removably couple said at least two divisible sections together.

4. The target system, according to claim 2, wherein:

a) such at least one torso portion of such at least one three-dimensional humanoid comprises at least one head portion; and b) said at least one second coupler is situate about the top of such at least one head of such at least one torso portion of such at least one three-dimensional humanoid.

5. The target system, according to claim 3, wherein said plurality of tab-slot couplers comprise a non-metallic-coupling structured and arranged to minimize bullet ricochet.

6. The target system, according to claim 2, wherein said at least one second coupler comprises at least one non-metallic material structured and arranged to minimize bullet ricochet.

7. The target system, according to claim 1, wherein said at least one second form representation comprises at least two two-dimensional portions that, when assembled provide at least one three-dimensional representation of at least one humanoid internal organ.

8. The target system, according to claim 1, wherein said at least one second form representation is geometrically couplable by slotted cross-sectionally-assembled portions comprising such at least one set of humanoid internal organ representation.

9. The target system, according to claim 1, wherein:

a) said at least one first form three-dimensional representation comprises at least one coronal plane and at least one sagittal plane;

b) said at least one first form three-dimensional representation comprises at least two divisible sections; and c) said at least one second form representation inserts into said at least one first form three-dimensional representation along the intersection of said sagittal plane and said coronal plane cross-sections.

10. The target system, according to claim 4, wherein said at least one second form representation comprises at least one brain representation structured and arranged to couple inside such at least one head portion.

11. The target system, according to claim 1, wherein said at least one first form three-dimensional representation comprises essentially thermoformed molded fiber in its entirety.

12. The target system, according to claim 1, wherein said at least one first form three-dimensional representation comprises essentially thick-wall molded pulp in its entirety.

13. The target system, according to claim 9, wherein said at least one first form three-dimensional representation comprises at least two divisible sections along such at least one coronal plane.

14. The target system, according to claim 1, wherein said at least one second form representation comprises shot demarcation indicia structured and arranged to assist determination of organ target-penetration when penetrated.

15. The target system, according to claim 14, wherein said shot demarcation indicia is structured and arranged to indicate, and assist determination of, angular shot geometry when penetrated.

16. A target system, relating to at least one three-dimensional target to assist a shooter of the target to determine associated internal organ damage upon striking the target, comprising:

a) first form three-dimensional representation means for form representation of at least one torso portion of at least one three-dimensional humanoid;

b) second form representation means for representing at least one set of humanoid internal organs; and, c) first coupler means for coupling said second form representation means within said first form three-dimensional representation means;

d) wherein said first coupler means comprises removable inserter means for inserting said second form representation means into said first form three-dimensional representation means;

e) wherein said second form representation means comprises three-dimensional representation means for three-dimensional representing of at least one set of humanoid internal organs;

f) wherein when said second form representation means is inserted into and coupled with said first form three-dimensional representation means the at least one three-dimensional target is provided;

g) first divisible geometry means for geometrically dividing said first form three-dimensional representation means into at least two divisible sections;

h) wherein said first form three-dimensional representation means comprises second coupler means for coupling said at least two divisible sections together;

i) wherein said first divisible geometry means, when geometrically divided, assists said second form representation means insertion into said first form three-dimensional representation means;

j) second divisible geometry means for geometrically dividing said second form representation means into at least two divisible sections;

k) wherein said second form representation means comprises third coupler means for coupling said at least two divisible sections together;

l) wherein when said second form representation means is geometrically divided, said second form representation means is two-dimensional; and m) wherein when said second form representation means is geometrically coupled by said third coupler means, said second form representation means is three-dimensional.

* * * * *